US012796782B2

(12) United States Patent
Kruse

(10) Patent No.: US 12,796,782 B2
(45) **Date of Patent: *Nov. 17, 2026**

(54) SYSTEMS AND METHODS FOR A ROTARY CLOSURE

(71) Applicant: Pride Manufacturing Company, LLC, Brentwood, TN (US)

(72) Inventor: Randon Kruse, Sheridan, WY (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 55 days.

This patent is subject to a terminal disclaimer.

(21) Appl. No.: 18/959,445

(22) Filed: Nov. 25, 2024

(65) Prior Publication Data

US 2025/0082068 A1 Mar. 13, 2025

Related U.S. Application Data

(63) Continuation of application No. 18/748,696, filed on Jun. 20, 2024, now Pat. No. 12,150,525.

(Continued)

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/00; A43C 11/06; A43C 11/08; A43C 1/06; A43C 11/16;

(Continued)

(56) References Cited

U.S. PATENT DOCUMENTS 4,787,124 A 11/1988 Pozzobon et al.
5,042,177 A 8/1991 Schoch (Continued)

FOREIGN PATENT DOCUMENTS

CA 2712379 A1 7/2009
CA 2804759 C 6/2019

(Continued)

OTHER PUBLICATIONS

International Search Report and Written Opinion dated Aug. 8, 2024, from PCT application PCT/US2024/019711.

(Continued)

*Primary Examiner* — Jack W Lavinder
*Assistant Examiner* — Rowland Do
(74) *Attorney, Agent, or Firm* — Dentons Durham Jones Pinegar; Sarah W. Matthews

(57) ABSTRACT

A rotary closure system includes a dial with a projection on an underside of the dial to engage a pawl assembly, the pawl assembly in connection with teeth of a housing. The housing receives a spool therein, and the housing has teeth around a peripheral edge, the pawl assembly engageable with the teeth of the housing. A base member or flange may be coupled or integral to the housing for connecting the rotary closure system to an article of clothing, such as a shoe. The rotary system has a first, locked position and a second, unlocked position. In the first, locked position, an inner arm of the pawl assembly engages the spool and a tooth of the housing. In the second, unlocked position, the inner arm of the pawl assembly disengages the spool.

8 Claims, 23 Drawing Sheets

Related U.S. Application Data

(60) Provisional application No. 63/551,420, filed on Feb. 8, 2024, provisional application No. 63/534,239, filed on Aug. 23, 2023.

(58) Field of Classification Search
CPC ..... A43C 11/20; Y10T 24/2183; Y10T 24/37; Y10T 24/2187; Y10T 24/3703; Y10T 24/3713; Y10T 24/3724
See application file for complete search history.

(56) References Cited

U.S. PATENT DOCUMENTS

| | | | | |
|---|---|---|---|---|
| 5,177,882 | A | 1/1993 | Berger | |
| 5,181,331 | A | 1/1993 | Berger | |
| 5,319,868 | A | 6/1994 | Hallenbeck | |
| 5,327,662 | A | 7/1994 | Hallenbeck | |
| 5,638,588 | A | 6/1997 | Jungkind | |
| 5,669,116 | A | 9/1997 | Jungkind | |
| 5,737,854 | A | 4/1998 | Sussmann | |
| 5,934,599 | A | 8/1999 | Hammerslag | |
| 6,711,787 | B2 | 3/2004 | Jungkind et al. | |
| 7,516,914 | B2 | 4/2009 | Kovacevich et al. | |
| 7,591,050 | B2 | 9/2009 | Hammerslag | |
| 7,950,112 | B2 | 5/2011 | Hammerslag et al. | |
| 8,231,074 | B2 | 7/2012 | Hu et al. | |
| 8,235,321 | B2 | 8/2012 | Chen | |
| 8,516,662 | B2 | 8/2013 | Goodman et al. | |
| 8,984,719 | B2 | 3/2015 | Soderberg et al. | |
| 9,072,341 | B2 | 7/2015 | Jungkind | |
| 9,101,181 | B2 * | 8/2015 | Soderberg | A43C 11/165 |
| 9,125,455 | B2 | 9/2015 | Kerns et al. | |
| 9,149,089 | B2 | 10/2015 | Cotterman et al. | |
| 9,179,729 | B2 | 11/2015 | Cotterman et al. | |
| 9,248,040 | B2 | 2/2016 | Soderberg et al. | |
| D751,281 | S | 3/2016 | Nickel et al. | |
| D758,061 | S | 6/2016 | Whewell | |
| 9,375,053 | B2 | 6/2016 | Burns et al. | |
| 9,408,437 | B2 | 8/2016 | Goodman et al. | |
| D767,269 | S | 9/2016 | Lovett et al. | |
| 9,486,039 | B2 | 11/2016 | Ha | |
| 9,516,923 | B2 | 12/2016 | Capra et al. | |
| D776,421 | S | 1/2017 | Venturini | |
| 9,532,626 | B2 | 1/2017 | Lovett et al. | |
| 9,610,185 | B2 | 4/2017 | Capra et al. | |
| 9,700,101 | B2 | 7/2017 | Lovett et al. | |
| 9,743,714 | B2 | 8/2017 | Hammerslag et al. | |
| 9,770,070 | B2 | 9/2017 | Cotterman et al. | |
| 9,872,568 | B2 | 1/2018 | Capra et al. | |
| 9,872,790 | B2 | 1/2018 | Capra et al. | |
| 10,004,297 | B2 | 6/2018 | Lovett | |
| 10,039,348 | B2 | 8/2018 | Cavanagh et al. | |
| 10,076,160 | B2 | 9/2018 | Burns et al. | |
| 10,123,589 | B2 | 11/2018 | Soderberg et al. | |
| D835,898 | S | 12/2018 | Lovett | |
| D835,976 | S | 12/2018 | Nickel et al. | |
| 10,413,019 | B2 | 9/2019 | Soderberg et al. | |
| 10,433,999 | B2 | 10/2019 | Hammerslag et al. | |
| 10,499,709 | B2 | 12/2019 | Pollack et al. | |
| 10,575,591 | B2 | 3/2020 | Schum et al. | |
| 10,702,409 | B2 | 7/2020 | Burns et al. | |
| 10,772,384 | B2 | 9/2020 | Whewell et al. | |
| 10,772,388 | B2 | 9/2020 | Burns et al. | |
| D897,661 | S | 10/2020 | Nickel | |
| 10,842,230 | B2 | 11/2020 | Pollack et al. | |
| 10,863,796 | B2 | 12/2020 | Soderberg et al. | |
| 10,888,139 | B2 | 1/2021 | Burns et al. | |
| 10,952,505 | B2 | 3/2021 | Hammerslag et al. | |
| D926,457 | S | 8/2021 | Swanson | |
| D926,458 | S | 8/2021 | Swanson et al. | |
| D932,176 | S | 10/2021 | Swanson et al. | |
| 11,220,030 | B2 | 1/2022 | Hipwood et al. | |
| 11,357,279 | B2 | 6/2022 | Cotterman | |
| D965,257 | S | 10/2022 | Hammerslag et al. | |
| 11,457,698 | B2 | 10/2022 | Burns et al. | |
| 11,492,228 | B2 | 11/2022 | Kruse et al. | |
| D971,562 | S | 12/2022 | Hipwood et al. | |
| RE49,358 | E | 1/2023 | Neiley et al. | |
| D983,510 | S | 4/2023 | Nickel et al. | |
| 11,633,020 | B2 | 4/2023 | Burns et al. | |
| 11,647,813 | B1 | 5/2023 | Rao | |
| 11,684,122 | B2 | 6/2023 | Burns et al. | |
| 11,707,870 | B2 | 7/2023 | Hipwood et al. | |
| 11,717,056 | B2 | 8/2023 | Converse et al. | |
| 11,751,633 | B2 | 9/2023 | Burns et al. | |
| 11,844,404 | B2 | 12/2023 | Burns et al. | |
| 11,903,451 | B2 | 2/2024 | Pollack et al. | |
| 11,919,740 | B2 | 3/2024 | Kruse et al. | |
| 2002/0095750 | A1 | 7/2002 | Hammerslag | |
| 2007/0169378 | A1 | 7/2007 | Sodeberg et al. | |
| 2010/0139057 | A1 | 6/2010 | Soderberg et al. | |
| 2011/0266384 | A1 * | 11/2011 | Goodman | A43C 11/165 29/434 |
| 2013/0092780 | A1 | 4/2013 | Soderberg et al. | |
| 2014/0358054 | A1 | 12/2014 | Capra et al. | |
| 2015/0089779 | A1 | 4/2015 | Lawrence et al. | |
| 2015/0121669 | A1 | 5/2015 | Jungkind | |
| 2015/0151070 | A1 | 6/2015 | Capra et al. | |
| 2015/0190262 | A1 | 7/2015 | Capra et al. | |
| 2015/0237962 | A1 | 8/2015 | Soderberg et al. | |
| 2015/0257489 | A1 | 9/2015 | Trudel | |
| 2016/0058130 | A1 | 3/2016 | Boney et al. | |
| 2016/0199231 | A1 | 7/2016 | Capra | |
| 2016/0286903 | A1 | 10/2016 | Whewell et al. | |
| 2016/0354223 | A1 | 12/2016 | Burns et al. | |
| 2017/0006951 | A1 | 1/2017 | Venturini et al. | |
| 2018/0271541 | A1 | 9/2018 | Figueiredo et al. | |
| 2019/0008236 | A1 * | 1/2019 | Ha | A43C 11/165 |
| 2019/0246747 | A1 | 8/2019 | Bock et al. | |
| 2020/0346888 | A1 | 11/2020 | Kruse et al. | |
| 2020/0390196 | A1 | 12/2020 | Manzato | |
| 2021/0112922 | A1 | 4/2021 | Bock | |
| 2021/0127794 | A1 | 5/2021 | Chen | |
| 2021/0127795 | A1 | 5/2021 | Chen | |
| 2021/0177098 | A1 | 6/2021 | Trudel et al. | |
| 2021/0298428 | A1 | 9/2021 | Bock et al. | |
| 2022/0079294 | A1 | 3/2022 | Bock et al. | |
| 2022/0175089 | A1 | 6/2022 | Pollack et al. | |
| 2022/0265001 | A1 | 8/2022 | Burt et al. | |
| 2022/0279900 | A1 | 9/2022 | Vladika et al. | |
| 2023/0031091 | A1 | 2/2023 | Kruse et al. | |
| 2023/0148710 | A1 | 5/2023 | Redon et al. | |
| 2023/0189936 | A1 | 6/2023 | Siegismund et al. | |
| 2023/0210219 | A1 | 7/2023 | Siegismund et al. | |
| 2023/0248116 | A1 | 8/2023 | Duller et al. | |
| 2023/0255320 | A1 | 8/2023 | Burt et al. | |
| 2023/0363488 | A1 | 11/2023 | Oberhauser et al. | |
| 2023/0363496 | A1 | 11/2023 | Soderberg et al. | |
| 2023/0363497 | A1 | 11/2023 | Sieismund | |
| 2023/0389655 | A1 | 12/2023 | Siegismund | |
| 2024/0000196 | A1 | 1/2024 | Stepanian et al. | |
| 2024/0008586 | A1 | 1/2024 | Manzato et al. | |
| 2024/0115008 | A1 | 4/2024 | Sussmann et al. | |

FOREIGN PATENT DOCUMENTS

| | | | |
|---|---|---|---|
| CN | 114901097 | A | 8/2022 |
| CN | 114947303 | A | 8/2022 |
| CN | 116916780 | A | 10/2023 |
| DE | 29701491 | U1 | 5/1998 |
| DE | 112011101525 | B4 | 7/2020 |
| EP | 2916680 | B1 | 12/2018 |
| EP | 3917350 | A4 | 10/2022 |
| EP | 3653073 | B1 | 1/2023 |
| EP | 3589151 | B1 | 6/2023 |
| JP | 5048096 | B2 | 10/2012 |

(56) References Cited

FOREIGN PATENT DOCUMENTS

| | | | |
|---|---|---|---|
| TW | 202243986 | A | 11/2022 |
| WO | 2009089609 | A1 | 7/2009 |

OTHER PUBLICATIONS

Taiwan Intellectual Property Office, "First Office Action," for Taiwan Patent Application No. 113112858, Dec. 6, 2024.

* cited by examiner

SYSTEMS AND METHODS FOR A ROTARY CLOSURE

RELATED APPLICATIONS

This application is a continuation of U.S. patent application Ser. No. 18/748,696, filed Jun. 20, 2024, now U.S. Pat. No. 12,150,525, issued Nov. 26, 2024 which claims priority under 35 U.S.C. 119(e) to U.S. provisional application No. 63/534,239 filed Aug. 23, 2023 and U.S. Provisional application No. 63/551,420 filed Feb. 8, 2024, which are both explicitly incorporated by reference herein in their entireties.

TECHNICAL FIELD

The present disclosure relates to closure systems used in combination in any of a variety of applications including clothing, for example in a low-friction lacing system for footwear that provides equilibrated tightening pressure across a wearer's foot.

RELATED ART

Previous efforts in rotary closure systems to lace a shoe, while being securely latched, can have inherent flaws such as the tendency to become locked into a de-tensioning position or become jammed when rotated too far in an incorrect rotational direction. Previous rotary closure designs included housings that fully encapsulate a spool, which can cause tensioning elements to become tangled inside the housing and can sometimes obstruct rotation of the spool. Further, if a mistake is made during assembly or components are misaligned, one risks damaging the rotary closure by attempting to and realign components of the rotary closure.

Additionally, prior rotary closure designs required manufacturing of mirrored components to form a left-handed and a right-handed rotary closure. Users and/or customers must choose which type of closure they desired beforehand.

It is with these observations in mind, among others, that various aspects of the present disclosure were conceived and developed.

SUMMARY

According to one aspect, a rotary closure system includes a dial with a projection on an underside of the dial to engage a pawl assembly. The pawl assembly is in connection with teeth of a housing, and the housing receives a spool therein. The housing has teeth around a peripheral edge, the pawl assembly engageable with the teeth, or with the spaces between the teeth. A flange or base member may be coupled or integral to the housing.

The rotary closure system has a first, locked position and a second, unlocked position. In the first, locked position, an inner arm of the pawl assembly engages the spool and a tooth of the housing. In the second, unlocked position, the inner arm of the pawl assembly disengages the spool.

In some embodiments, the pawl assembly comprises a first pawl and a second pawl. In some embodiments, the first pawl and the second pawl are reversible. In other embodiments, the first pawl and second pawl are directional and not reversible.

According to another aspect, the first pawl and the second pawl each comprise a body with: (i) a first inner arm for engaging the spool, (ii) a second outer arm for engaging the teeth of the housing and incrementally tightening the spool as the dial is turned in a locking direction in the first, locked position; and (iii) a third outer arm for engaging the dial. The second outer arm may include a ramped projection for engaging a tooth of the housing. The projection on the underside of the dial may comprise a first projection to engage a first pawl of the pawl assembly and a second projection to engage a second pawl of the pawl assembly.

According to another aspect, the first projection of the dial engages the third outer arm of the first pawl, and the second projection of the dial engages the third outer arm of the second pawl. In some embodiments, the dial further comprises a first protuberance on the underside of the dial and, in the second, unlocked position, the first protuberance is positioned radially inward from the ramped projection of the second outer arm of the first pawl, preventing the second outer arm of the first pawl from flexing radially inwardly. The first and second projections of the dial may be ramped.

According to another aspect, the third outer arm for engaging the dial includes a radially inwardly extending projection to interface with the dial projection and provide resistance between the first, locked position and the second, unlocked position.

According to one aspect, a rotary closure system includes a flange coupled to a housing, and a spool receivable within the housing. A first pawl element and a second pawl element engage an inner side of a dial and the housing. The first pawl element and the second pawl element form a pawl assembly.

According to another aspect, the pawl assembly has a first position to allow the rotary closure to be a right-handed rotary closure and a second position to allow the rotary closure to be a left-handed rotary closure.

According to yet another aspect, a method can be provided for manufacturing a rotary closure system. The method includes manufacturing a reversible pawl assembly such that the pawl assembly can be rotated or flipped top-to-bottom to allow the rotary closure system to be right- or left-handed. In some configurations, all components of the rotary system are manufactured the same, whether the system is for a right-or left-handed rotary system.

Other aspects of the disclosed subject matter, as well as features and advantages of various aspects of the disclosed subject matter, should be apparent to those of ordinary skill in the art through consideration of the ensuing description, the accompanying drawings, and the appended claims.

BRIEF DESCRIPTION OF DRAWINGS

The following drawings illustrate what are currently considered to be specific representative configurations for carrying out the disclosed subject matter and are not limiting as to embodiments which may be made in accordance with this disclosure. The components in the drawings are not necessarily to scale relative to each other. Like reference numerals designate corresponding parts throughout the several views.

DETAILED DESCRIPTION

Figure 1A:
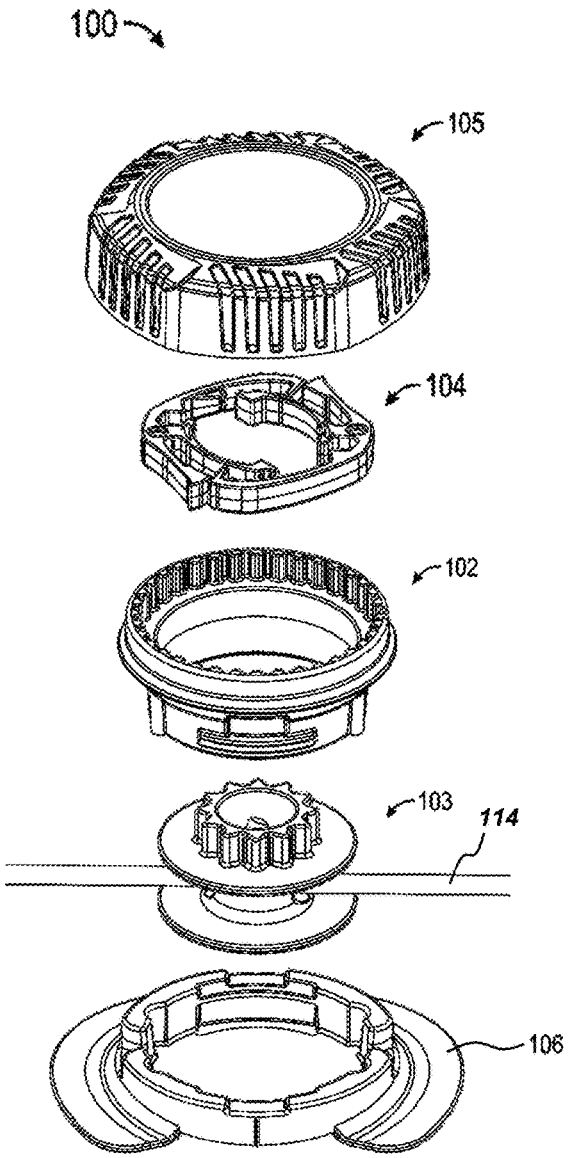
FIG. 1A is an illustration showing an top, perspective exploded view of various components of a first embodiment of a rotary closure.
Figure 1B:
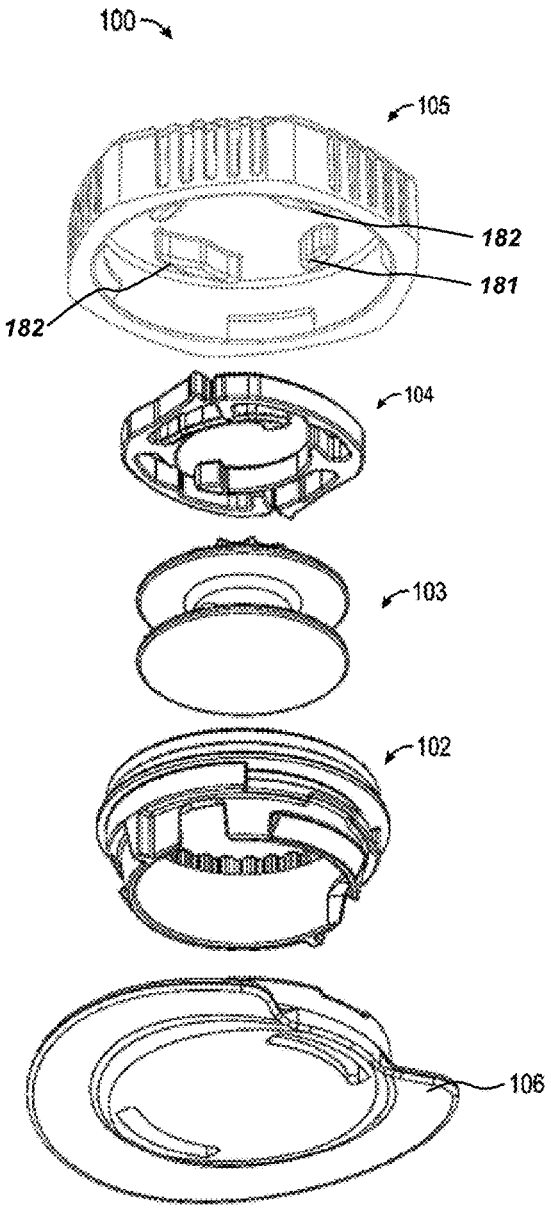
FIG. 1B is an illustration showing a bottom, perspective exploded view of various components of the rotary closure of FIG. 1.

This disclosure generally relates to a rotary closure. Various embodiments of a rotary closure are suitable for a right-handed wearer or when it is otherwise most convenient to wind the dial in a clockwise direction to tighten, and the reversible pawl assembly can be rotated 180 degrees to be used in an orientation suitable for a left-handed wearer or when it is otherwise most convenient to wind the dial in a counterclockwise direction to tighten. By merely rotating the reversible pawl assembly 180 degrees, the same spool, housing, dial, and base member can be used. It is not necessary to manufacture different parts. In other configurations, the rotary closure system is not identical for clockwise and counterclockwise tightening directions, i.e., the same pawl does not allow for a left-handed and right-handed tightening pawl system.

Additionally, a housing that provides an increased spool capacity and reduces jamming of a tensioning element that is to be repeatedly tensioned and de-tensioned around the spool. Referring to the drawings, embodiments of a rotary closure for a shoe are illustrated and generally indicated as 100.

One embodiment of the present disclosure is shown and described in a rotary closure of FIGS. 1A-2D. FIG. 1A shows a top, perspective exploded view of a rotary closure 100 with a tensioning element 114 and FIG. 1B shows a bottom, perspective exploded view of the rotary closure of FIG. 1A. As shown, the rotary closure 100 includes a dial 105, a pawl assembly 104, a housing 102, and a base member 106.

The dial 105 includes projections/bosses on the underside or inner surface 178 of the dial 105 to engage the pawl assembly 104, housing, and/or spool. The pawl assembly 104 is in connection with the teeth of the housing 102. The pawl assembly 104 has a locked position for engaging the spool 103, and an unlocked position for disengaging from the spool 103. The pawl assembly 104 may include one or more pawls. The housing 102 includes an opening to receive the spool 103 and teeth to engage the pawl assembly 104. A base member 106 is provided at the base of the housing 102 to receive the housing and connect the rotary closure system to footwear or another desired application. In the configuration shown in FIGS. 1A-1B, the flange is integral to the housing, in other words, the housing includes a flange at the base of the housing 102. In other embodiments, the flange can be a separate component that is connected to the housing 102.

The rotary closure 100 includes a housing 102 that engages the pawl assembly 104 and the dial 105 and further defines a spool passage 124 in which the spool 103 can be partially encapsulated. To assemble the rotary closure 100, the pawl assembly 104 is coupled with the dial 105, which are in turn coupled with the housing 102 to form a subassembly. The spool 103 can then be disposed within the spool passage 124 of the housing 102.

When assembled, the rotary closure system 100 has a locked position for engaging the spool 103, and an unlocked position for disengaging from the spool 103. In one embodiment, the locked position has each of the two members of the pawl assembly with (i) an inner arm 161 (FIG. 2A) that engages with the teeth of the spool 103 so rotation of the dial 105 rotates the spool 103, and (ii) an outer arm 162 with a ramped projection 163 that engages the teeth of the housing so the spool 103 can be turned only one way when the pawl assembly is in the locked position. A second outer arm may engage the dial 105. In the unlocked position (FIG. 2B) in this embodiment, the inner arm 161 released from the spool 103. That is, the unlocked position has each of the two members of the pawl assembly with (i) an inner arm 161 (FIG. 2B) that is disengaged from the teeth of the spool 103 so rotation of the dial 105 is de-coupled from rotation of the spool 103, and (ii) an outer arm 162 with a ramped projection 163 that remains engaged with the teeth of the housing. In other embodiments, the outer arm 162 may also optionally disengage from the teeth of the housing.

Figure 2A:
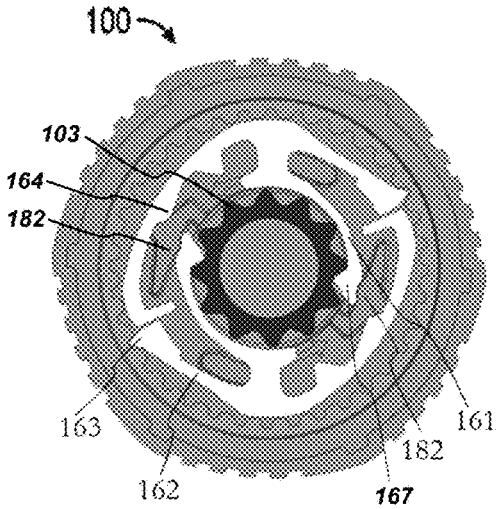
FIG. 2A is a top, cross-sectional view of an embodiment of a rotary closure system showing the pawl assembly in a locked position that allows tightening of the rotary closure system.
Figure 2B:
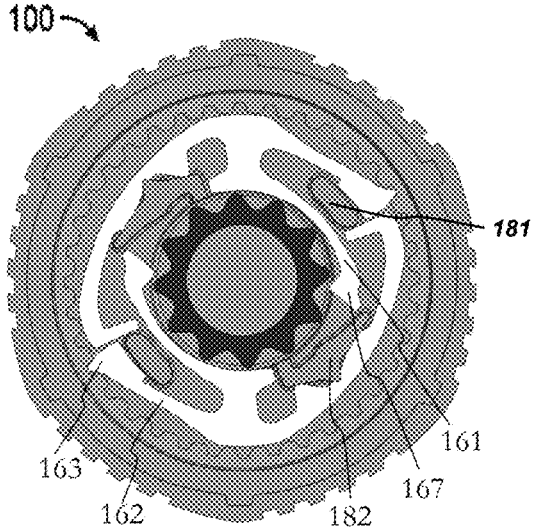
FIG. 2B is a top, cross-sectional view of the rotary closure system of FIG. 2A with the pawl assembly in an unlocked position that allows loosening of the rotary closure system.
Figure 2C:
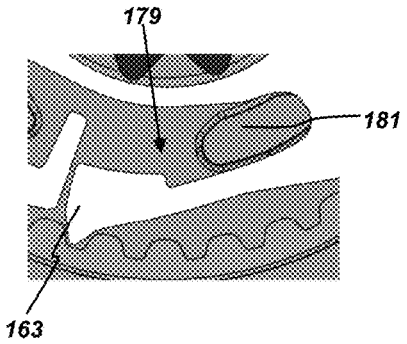
FIG. 2C is a close-up view of a portion of the rotary closure system shown in FIG. 2A in the locked position.
Figure 2D:
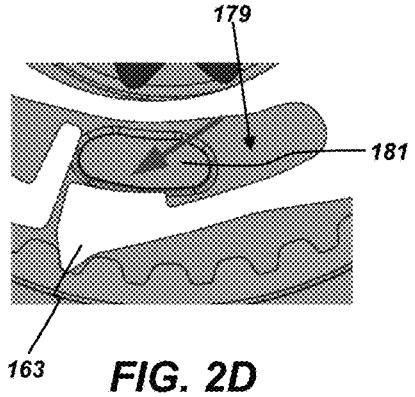
FIG. 2D is a close-up view of a portion of the rotary closure system shown in FIG. 2B in the unlocked position.

In use, the rotary closure system is installed in the desired direction to tighten (for example, as shown in FIGS. 2A-2B, the direction to tighten is illustrated as counter-clockwise). To tighten the tensioning element or lace, the dial is rotated in the tightening (or locking) direction, with the dial 105 turning the spool 103 through its connection to the spool 103 via the inner arm 161 of the pawl assembly 104. Inner arm 161 of the pawl assembly 104 is coupled to the dial 105 via projection 182 on the inner surface of dial 105. The ramped projection 163 of the outer arm 162 incrementally tightens the spool 103 as it moves along each tooth of the housing 102. To release the tensioning element or lace, the dial is rotated in the unlocking direction (here counterclockwise, see FIG. 2B), and the projections or ramps on the underside of the dial no longer press the pawl assembly into the spool teeth, allowing the spool 103 to rotate freely in the unlocked position.

In some embodiments, a projection 164 is provided on one or more of the outer arms 162 of the pawl assembly. This radially inwardly extending projection 164 engages with the radially outward side of the dial 105 projection 182, providing designed resistance between the locked and unlocked positions.

While FIGS. 2A-2B illustrate a directional dial 105 with pawl assembly 104, either a directional or a non-directional dial 105 can be used as desired. Dials with a specific directionality may increase system strength. Similarly, other aspects of the system can be directional or non-directional, such as the teeth of the spool, the teeth of the housing, etc.

In some embodiments, the dial further includes one or more projections on the inner or underside of the dial 105 for engagement with the pawl. Pawl engagement projections may be, in some embodiments, one or more bosses 181, one or more ramps 182, etc. In some embodiments, one projection is provided. In other embodiments, two, three, four, or more pawl-engagement projections may be provided. The projections may be any suitable shape and/or size desired, and may be located at any position on the underside of the dial as desired. For example, a single boss may be provided to engage one or more pawls such that as the dial rotates, the boss engages the pawl and similarly rotates the pawl. Alternatively, the projections may be positioned and/or shaped to bias the pawl, such as to bias an arm of the pawl inwardly or outwardly as desired.

In one embodiment, two bosses 181 are provided on the underside of the dial. The bosses have an ovular shape, but other shapes can also be used. In the unlocked position (see FIG. 2B and specifically the arrow in FIG. 2D), the bosses are positioned directly radially inward from the ramped projection(s) 163 of the pawl assembly 104 outer arm(s) 162, preventing the ramped projection(s) 163 from being able to flex radially inwardly to click forward on the housing teeth. Until the dial projections 181 engage the inner arm(s) 161 of the pawl assembly 104, and push the inner arms(3) into the spool teeth, the protuberances will prevent the pawl assembly 104 from clicking forward with respect to the housing. Once the inner arm(s) are engaged, the protuberances 181 clear away from the ramped projection(s) 163 of the pawl (see FIG. 2C), allowing them to click forward on the housing.

In the locked position (see FIGS. 2A and 2C), the bosses 182 are seated in a slot 179 that is formed in the pawl between the first, inner arm and the second, outer arm of the pawl assembly. The slot 179 receives the boss 181 and rotationally locks the dial and the pawl assembly such that rotation of the dial in a locking direction rotates the pawl assembly in a locking direction.

Figure 3A:
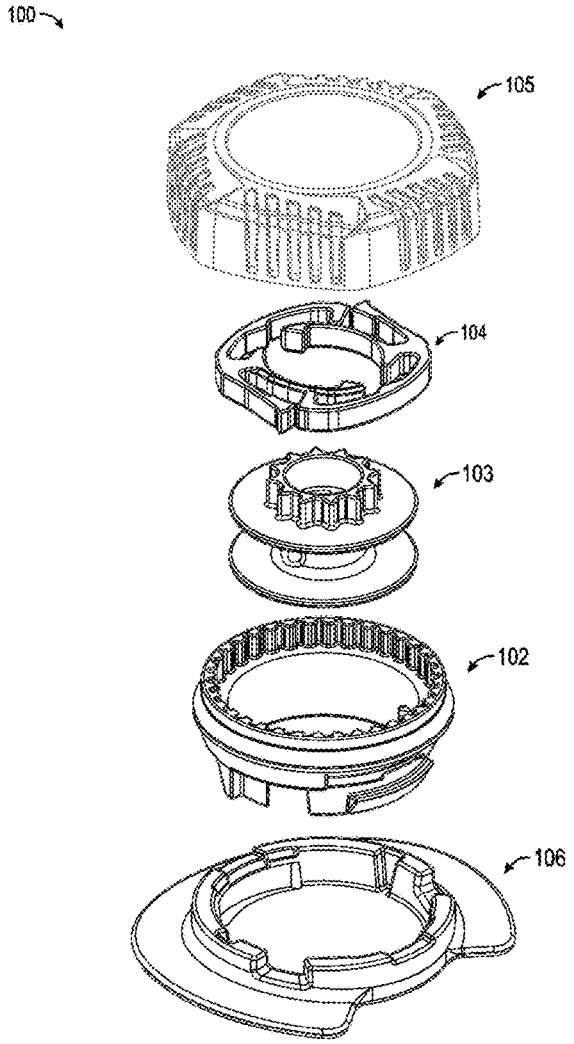
FIG. 3A is an illustration showing an top, perspective exploded view of various components of a first embodiment of a rotary closure.

Another embodiment of the present disclosure is shown and described in a rotary closure of FIGS. 3A-6B. FIG. 3A shows a top, perspective exploded view of a rotary closure 100 and FIG. 3B shows a bottom, perspective exploded view of the rotary closure of FIG. 3A. As shown, the rotary closure 100 includes a dial 105 for rotation of a spool 103 and an improved reversible pawl assembly 104. The reversible pawl assembly 104 is attached to the inner surface 178 of the dial 105 by two opposing ramps 182 on the underside of the dial 105 as described in more detail below.

Figure 6A:
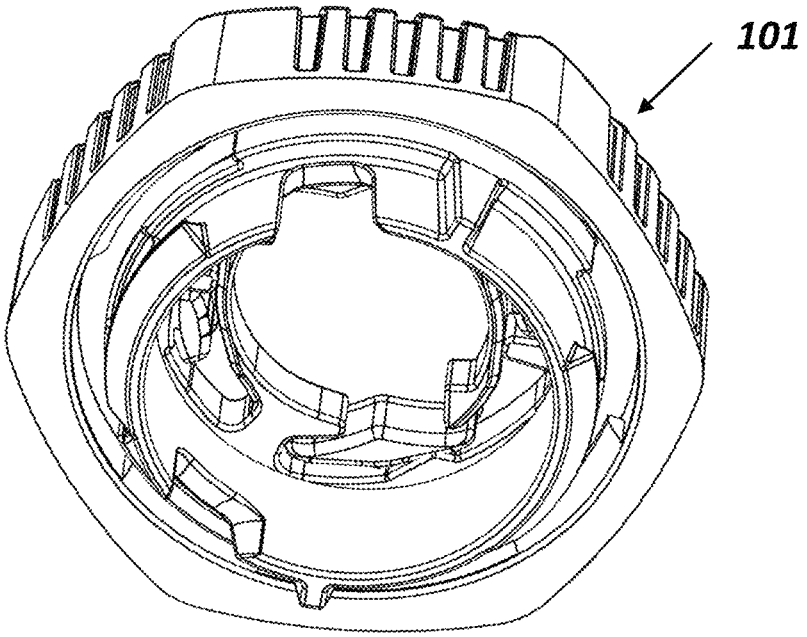
FIGS. 6A and 6B are a series of illustrations showing a bottom perspective view of a subassembly of the rotary closure of FIGS. 3A-3B prior to and following engagement of a spool with the subassembly.
Figure 6B:
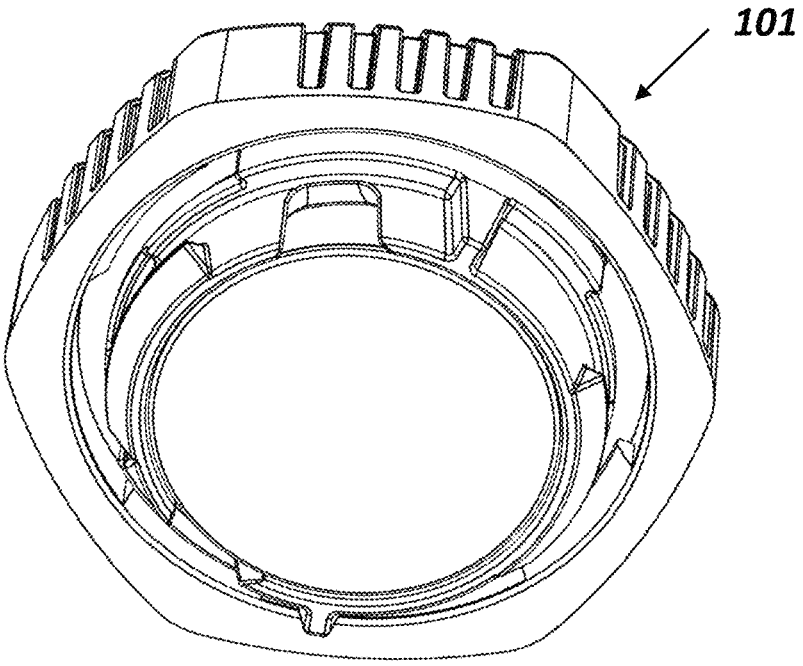

The rotary closure 100 includes a housing 102 that engages the pawl assembly 104 and the dial 105 and further defines a spool passage 124 in which the spool 103 can be partially encapsulated. To assemble the rotary closure 100, the pawl assembly 104 is coupled with the dial 105, which are in turn coupled with the housing 102 to form a subassembly 101 illustrated in FIG. 6A. The spool 103 can then be disposed within the spool passage 124 of the housing 102, as illustrated in FIG. 6B.

When assembled, the dial 105 operatively engages the pawl assembly 104 and the spool 103 to rotate the spool 103 within the housing 102 in a first rotational direction to tension the tensioning element around the spool, and a second rotational direction to de-tension the tensioning element. When assembled, the components of the subassembly 101 and the spool 103 are aligned along a common center axis. The assembled spool 103 and subassembly 101 including the dial 105, pawl assembly 104, and housing 102 may then be coupled to a base member 106, which is secured along an exterior portion of a shoe (not shown) to complete assembly. In some embodiments, the dial 105 can include a logo or other indicia. In some embodiments, the base member 106 is not a separate element; rather, a flange or other suitable mechanism can be integral to the housing 102 to allow the rotary closure 100 to be sewn or otherwise attached to a shoe, etc.

Figure 3B:
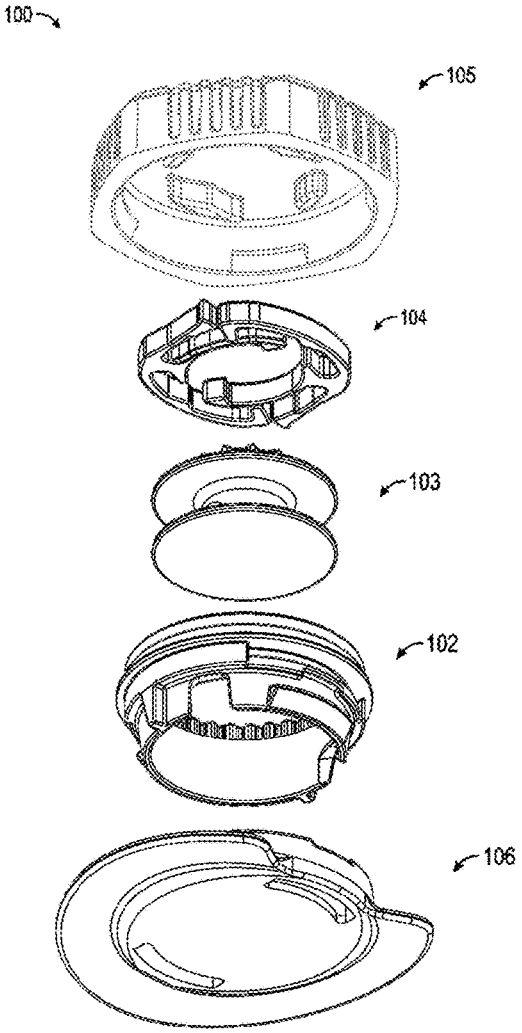
FIG. 3B is an illustration showing a bottom, perspective exploded view of various components of the rotary closure of FIG. 3A.
Figure 4:
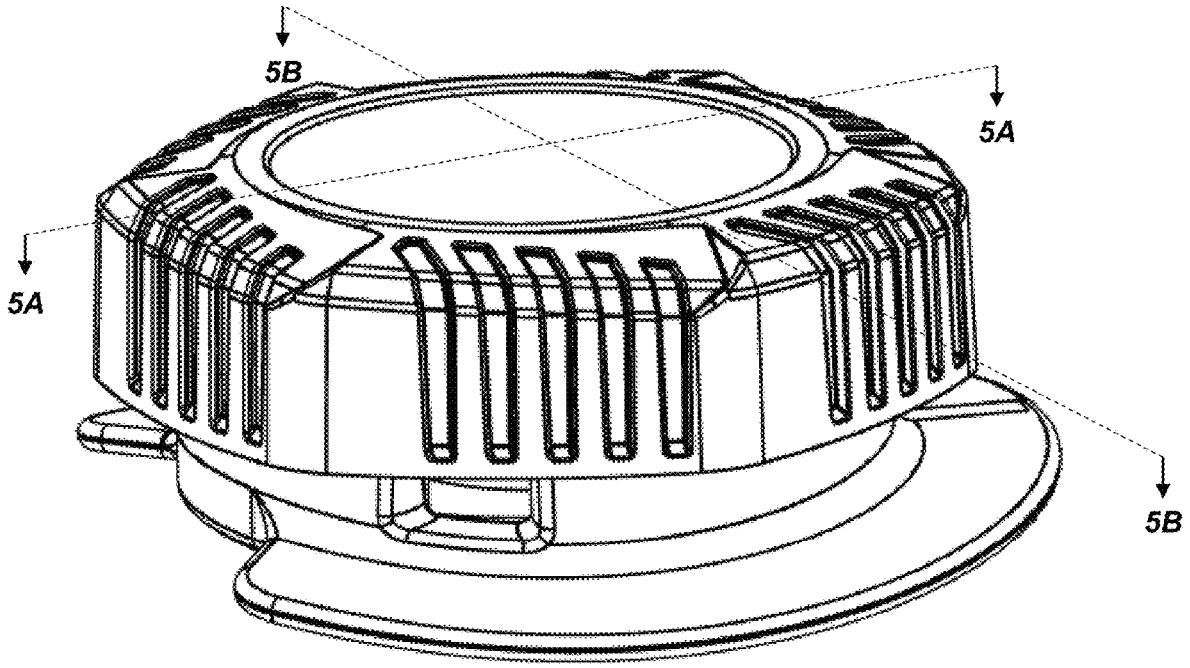
FIG. 4 is an illustration showing an assembled view of the rotary closure of FIGS. 3A-3B.
Figure 5A:
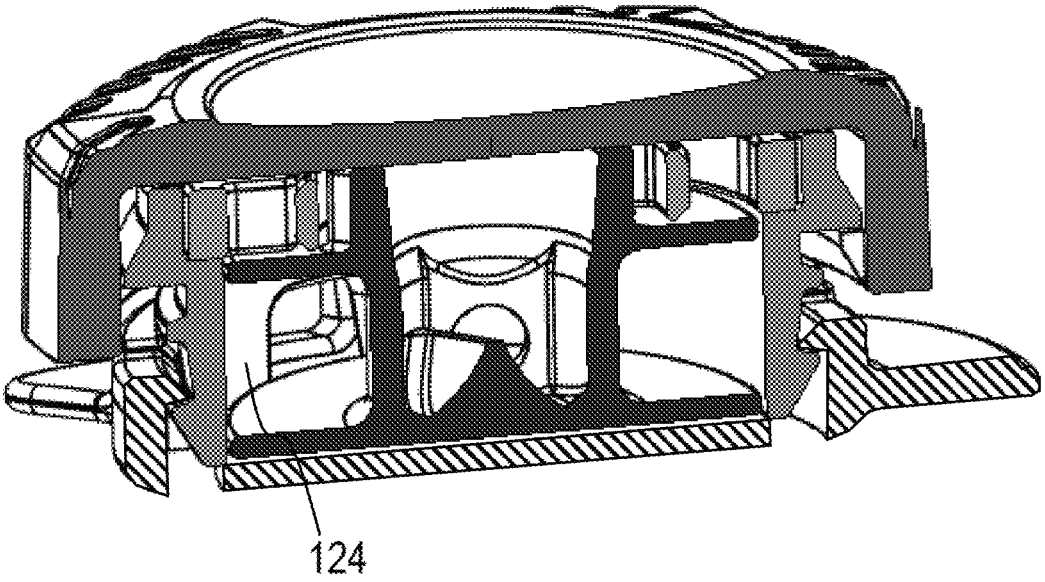
FIG. 5A is an illustration showing a section view of the rotary closure of FIG. 1 taken along line 5A-5A of FIG. 4.
Figure 5B:
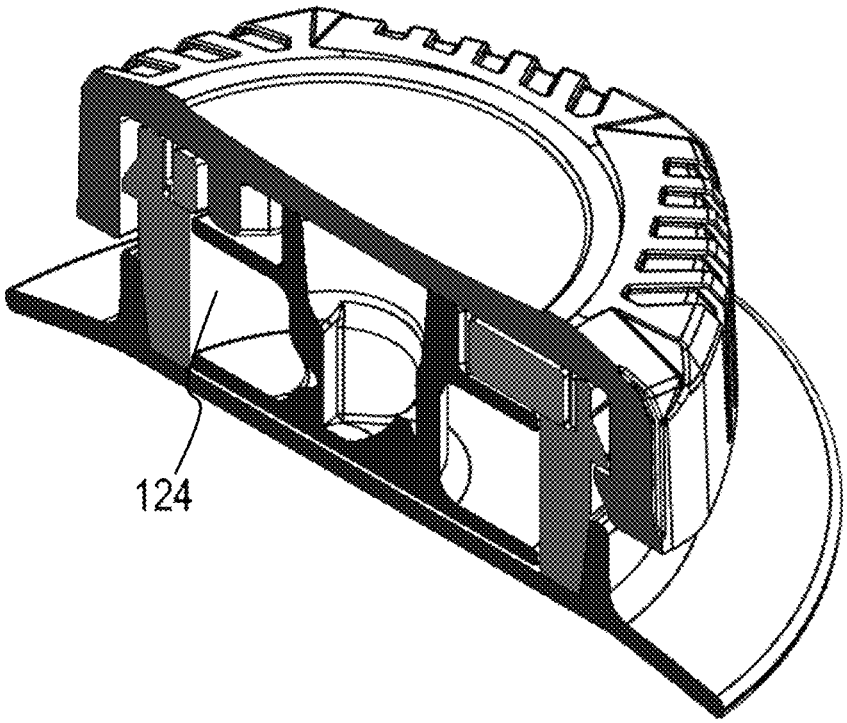
FIG. 5B is an illustration showing a section view of the rotary closure of FIGS. 3A-3B taken along line 5B-5B of FIG. 4.
Figure 7A:
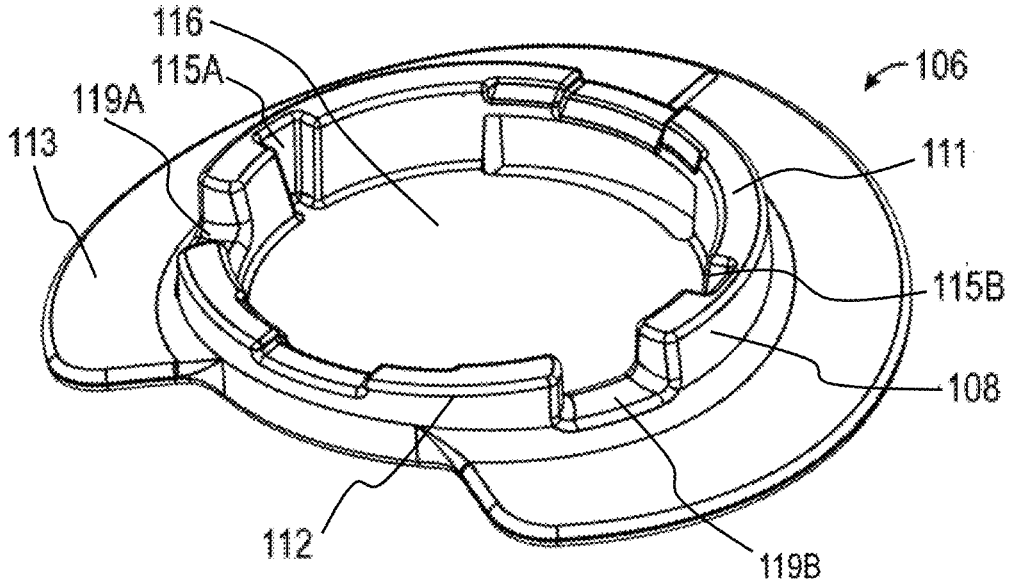
FIGS. 7A-7C are a series of illustrations showing top perspective, bottom perspective, and top plan views of the flange or base member of the rotary closure of FIGS. 3A-B defining a solid flange floor.
Figure 7B:
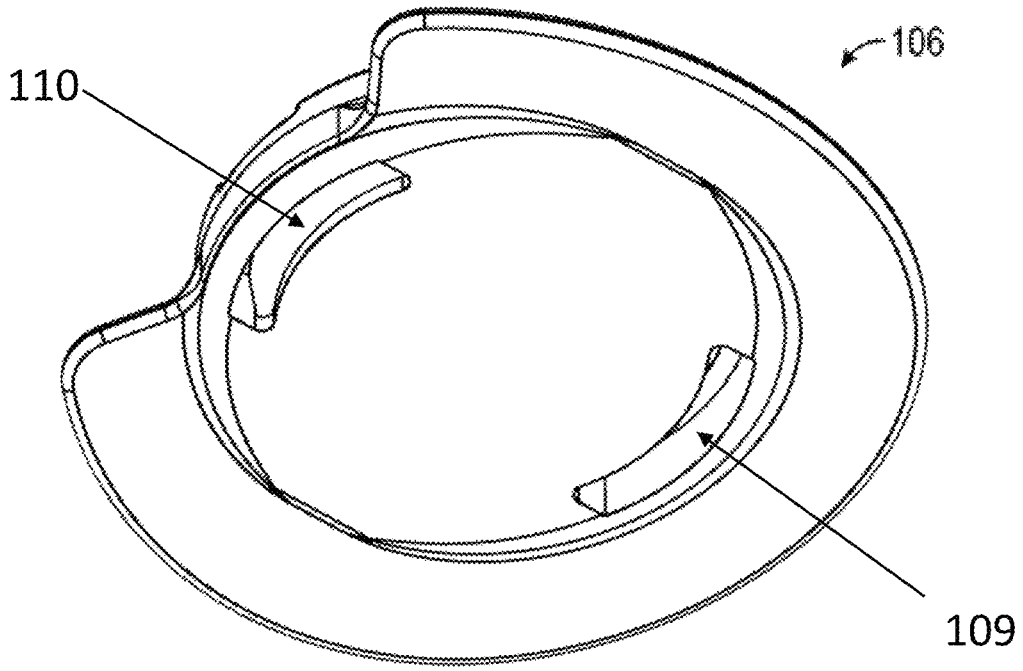
Figure 7C:
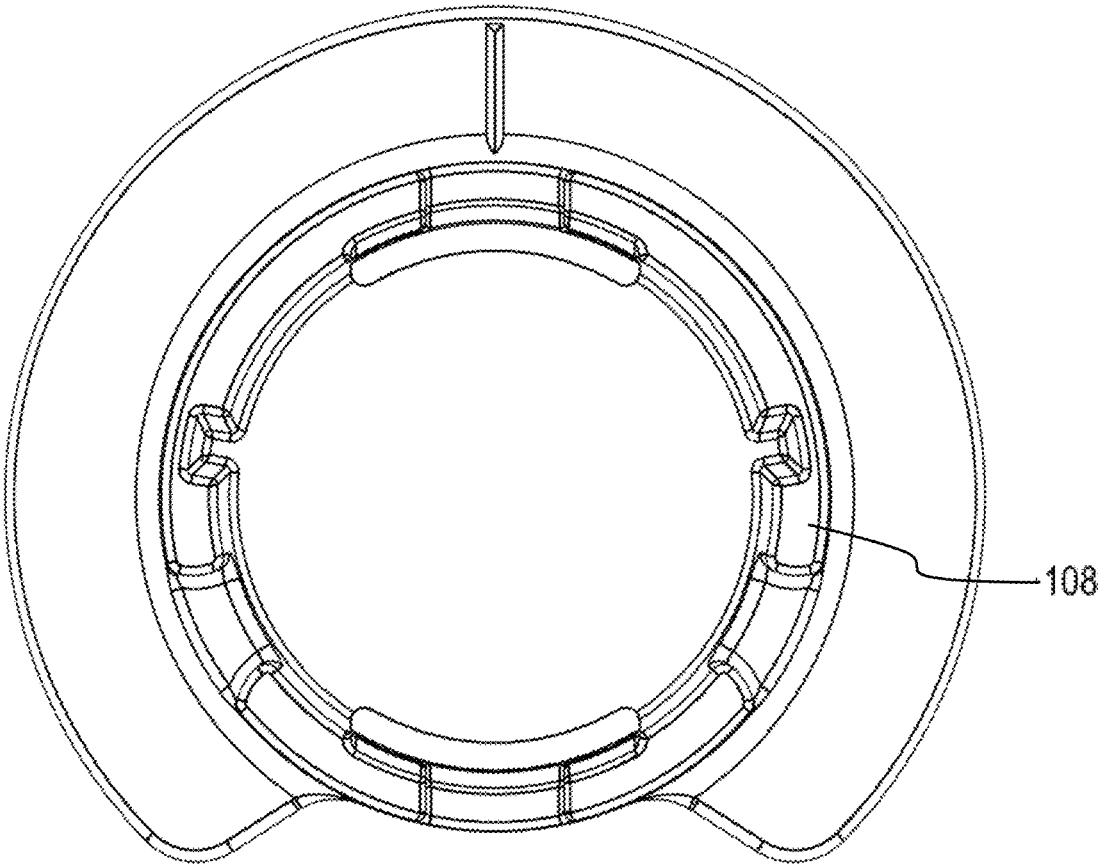

Referring to FIGS. 7A-7C, in some embodiments the base member 106 couples the assembled components of the rotary closure 100 to a shoe or another item by engagement with the housing 102 (FIGS. 3A-3B). In some embodiments, the base member 106 defines a closed body 108 having a circular shape forming a flange floor 116 for engaging the housing 102 during assembly. The closed body 108 of the flange encloses an underside of the spool 103 and couples with the housing 102 such that the spool 103 is collectively enclosed between the dial 105, the housing 102 and the base member 106.

The closed body defines a first flange wall 111 and an opposite second flange wall 112 that envelop the housing 102, and a rim 113 that extends beyond the first and opposite second flange walls 111 and 112. The first flange wall 111 and the opposite second flange wall 112 collectively define a first flange window 119A and an opposite second flange window 119B for passage of a tensioning element when assembled. The flange floor 116 of the base member 106 forms a plurality of seats 115A-B that accept a plurality of respective shoulders 129A-B (FIG. 8B) of the housing 102.

The base member 106 further includes a first a first slot 109 formed opposite a second slot 110 for coupling opposite sides of the housing 102 to the base member 106. The housing 102 may include first and second retention members (127A and 127B, see FIGS. 8A-C, below) to engage with first slot 109 and second slot 110, respectively.

Figure 8A:
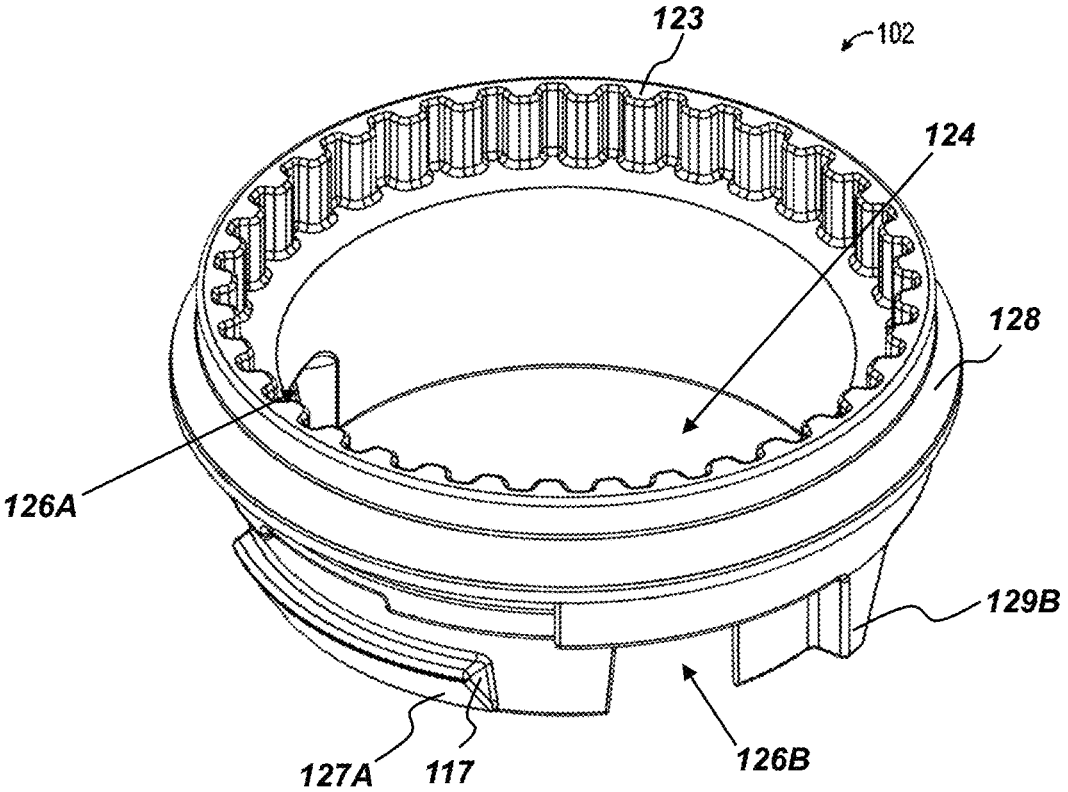
FIGS. 8A-8C are a series of illustrations showing top perspective, bottom perspective, and top plan views of the flange of the rotary closure of FIGS. 3A-B defining a solid flange floor.
Figure 8B:
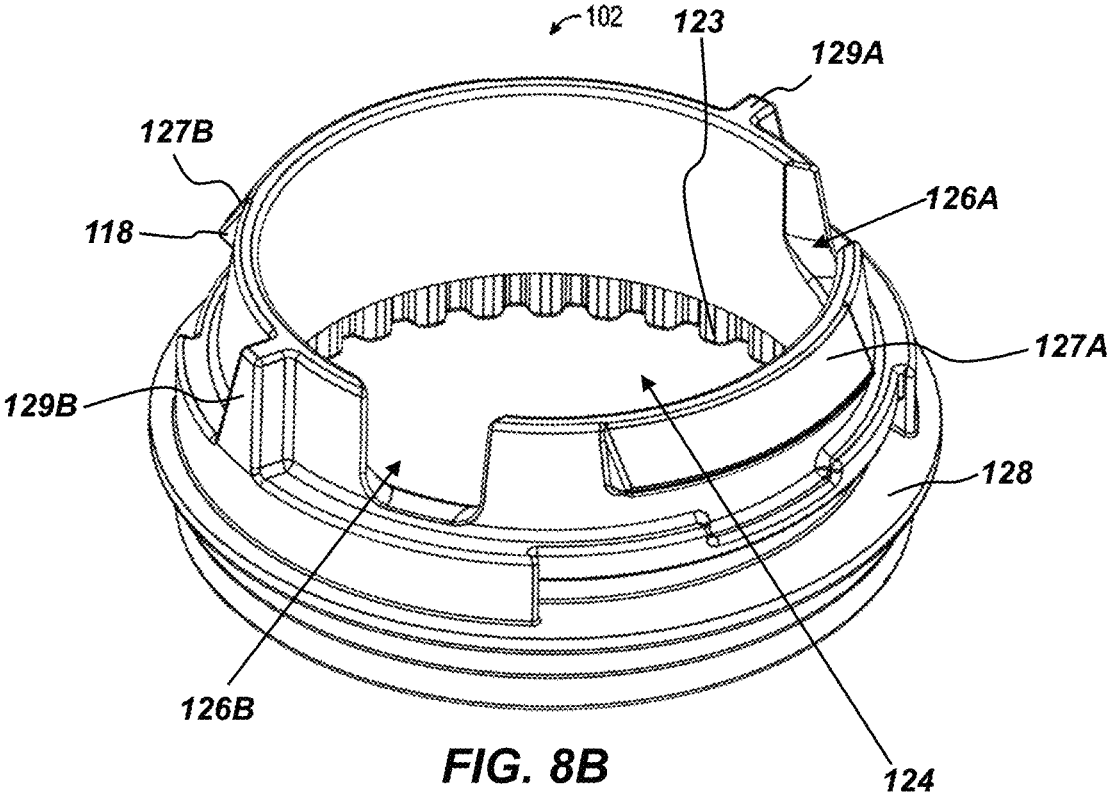
Figure 8C:
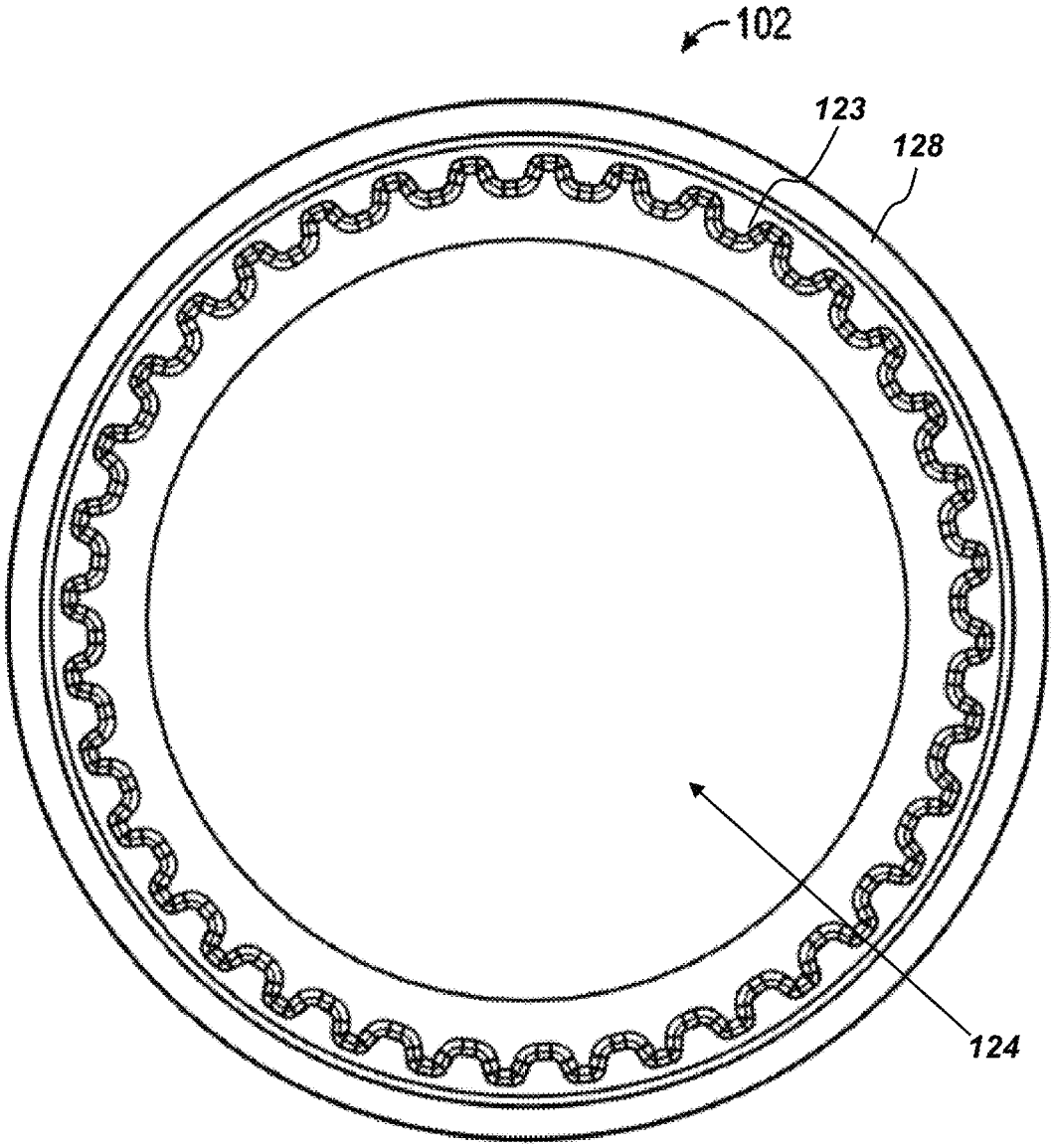

FIGS. 8A-8C illustrate the housing 102 for the rotary closure 100. In some embodiments, the housing 102 forms a generally circular body 120 defining the spool passage 124 for receipt and rotation of the spool 103. The circular body 120 defines a circular inner wall 121 formed coaxially within a circular outer wall 122. As shown, the circular outer wall 122 defines a circumferential flange 128 around an exterior of the circular outer wall 122 which is configured for engagement with the dial 105; such an engagement is illustrated in FIG. 6A. The circular outer wall 122 also defines a plurality of teeth 123 along an interior of the circular outer wall 122 for engaging the pawl assembly 104. The spool passage 124 is defined though the center of the housing 102; a diameter of the spool passage 124 enables placement and free rotation of the spool 103 within the spool passage 124.

As further shown in FIG. 6B, the spool passage 124 partially encapsulates the spool 103 and permits access to an underside of the spool 103 while the spool 103 is disposed within the housing 102. The plurality of teeth 123 of the housing 102 operatively engage a first reversible pawl assembly arm 161 of a first pawl element and a second reversible pawl assembly arm of a second pawl element of the pawl assembly 104 (FIGS. 10A-10D) as the dial 105, pawl assembly 104 and spool 103 are caused to incrementally rotate in a first rotational direction while the tensioning elements are being tightened around the spool 103. In some configurations, the plurality of teeth 123 of the housing 102 are generally symmetrical to allow the reversible pawl assembly 104 to rotate in either a clock-wise or counter-clockwise direction, an operation which will be described in greater detail below.

In some embodiments, as shown in FIG. 8B, the housing 102 defines a pair of opposing retention members 127A and 127B configured for engagement with a first slot 109 and second slot 110, respectively, of the base member 106 during assembly of the rotary closure 100. In some configurations, the first and second retention members 127A and 128B form first and second tang portions 117 and 118, respectively, at the free ends thereof. The first and second tang portions 117 and 118 may couple with the slots of the housing 102 in a snap fit engagement.

The housing also defines a first arch 126A and a second arch 126B configured for passage of one or more lacing (tensioning) elements (not shown) between an interior of the spool passage 124 and an exterior of the housing 102. Referring briefly back to FIG. 6B, when assembled, the first and second arches 126A and 126B enable access the tensioning element (not shown) and the spool 103 while the spool 103 is coupled within the housing 102. The first and second arches 126A and 126B may reduce the likelihood that the tensioning element will become jammed, especially with both tensioning and de-tensioning functionalities required of the rotary closure 100.

Referring to FIGS. 9A-9F, the spool 103 controls the operation of a tensioning element (114 in FIGS. 9E and 9F) such as a cable or wire, used to lace a shoe (not shown) by operation of the rotary closure 100 which is seated within the spool passage 124 of housing 102 (as shown in FIG. 6B). In some embodiments, the spool 103 includes a body 130 forming a spool base 132 and a spool flange 131 that collectively define a neck 134 and an extension 133 that extends axially from the spool flange 131. The neck 134 receives the tensioning element which is to be wound around the neck 134. The extension 133 forms a plurality of teeth 136 that collectively form a plurality of recesses 140 in juxtaposition between respective ridges 141 formed circumferentially around the peripheral edge 137 of extension 133 for engagement with the pawl assembly 104 (FIGS. 10A-10D).

The teeth 136 operatively engage a pawl member 152 of the pawl assembly 104 for turning the spool 103 in the first rotational direction, essentially "catching" the spool 103 and forcing the spool 103 to rotate in the first rotational direction with the dial 105 and pawl assembly 104. As further shown, in some embodiments the body 130 of the spool 103 defines a first window 144 and a second window 145. Structurally, the first and second windows 144 and 145 allow passage of the tensioning element to secure the tensioning element to the body 130 of the spool 103 while the tensioning element is being wound around the spool 103 during operation of the rotary closure 100.

Figure 9A:
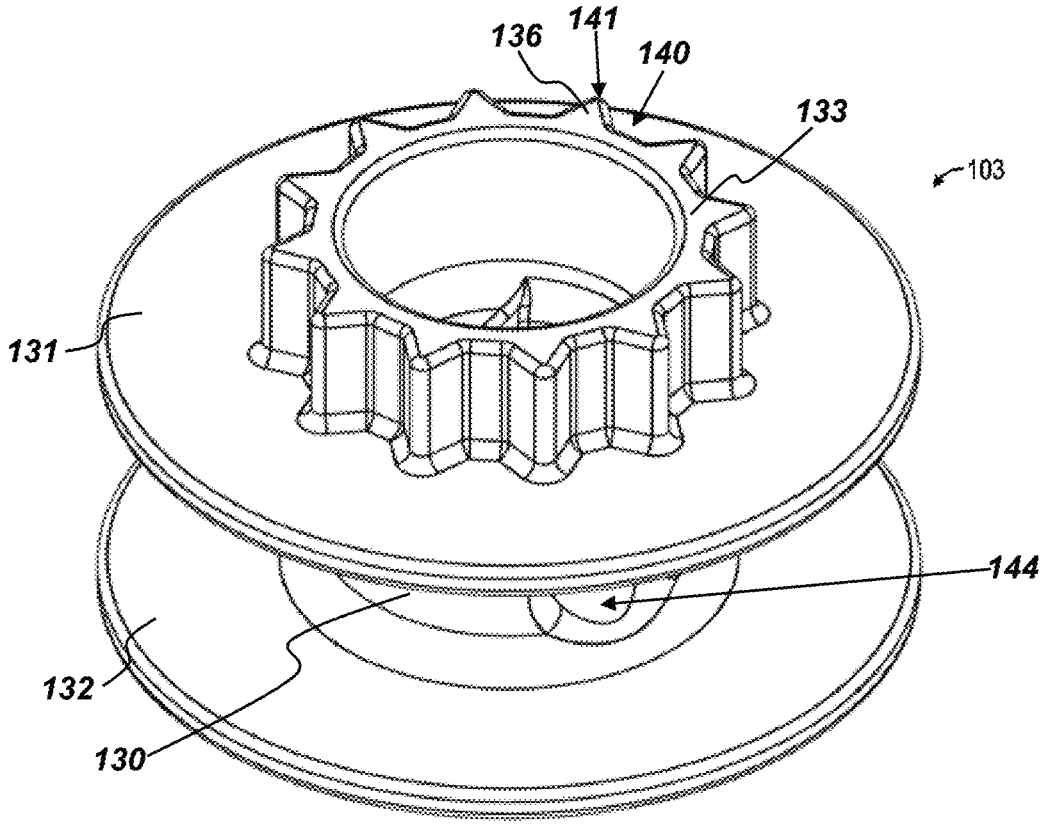
FIGS. 9A-9D are a series of illustrations showing top perspective, bottom perspective, top plan and side views of the spool of the rotary closure of FIGS. 3A-B.
Figure 9B:
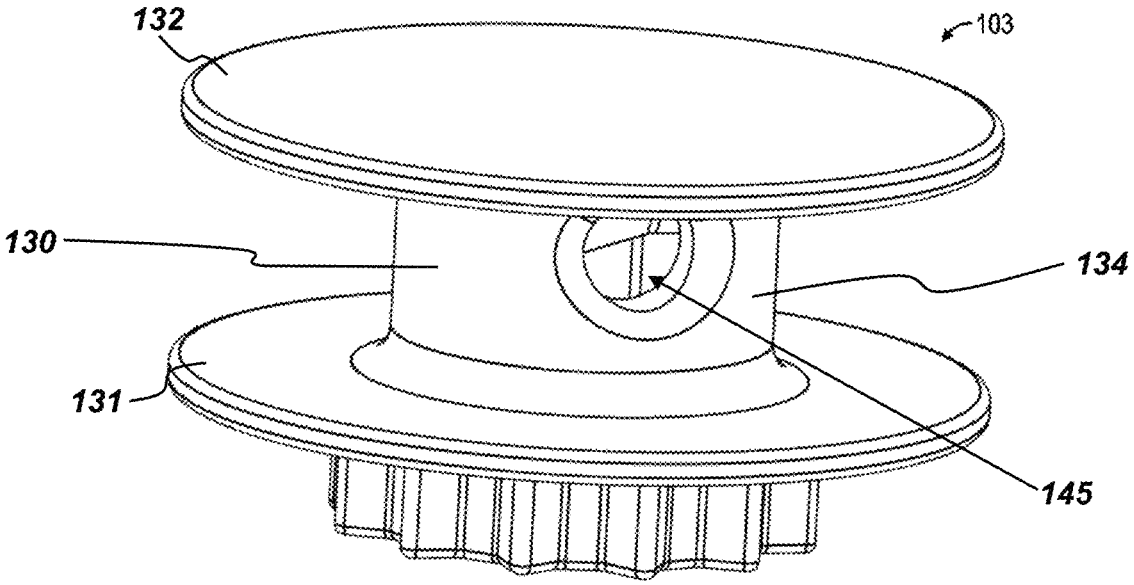
Figure 9C:
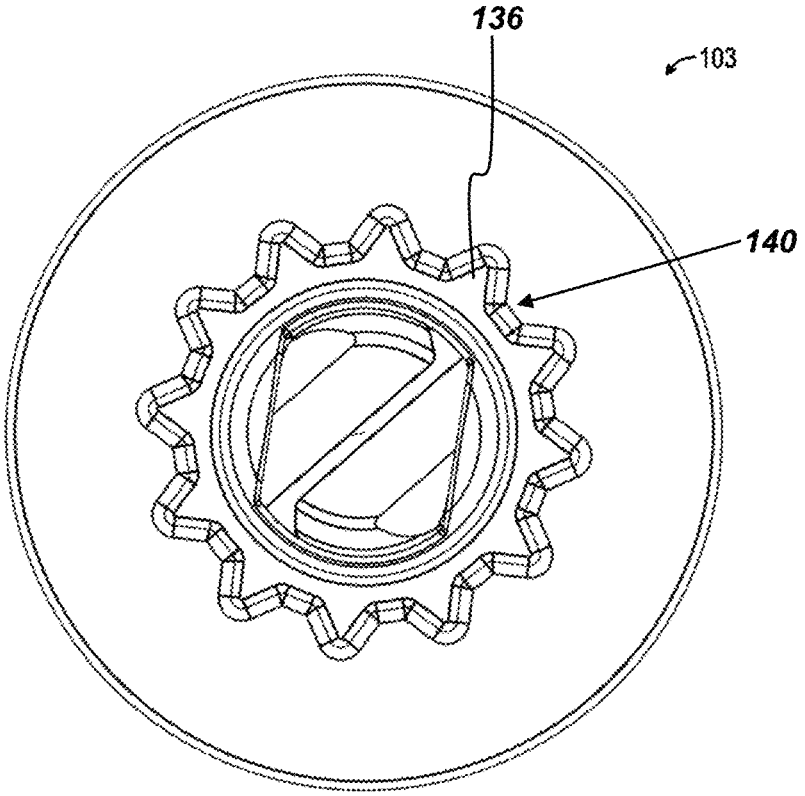
Figure 9D:
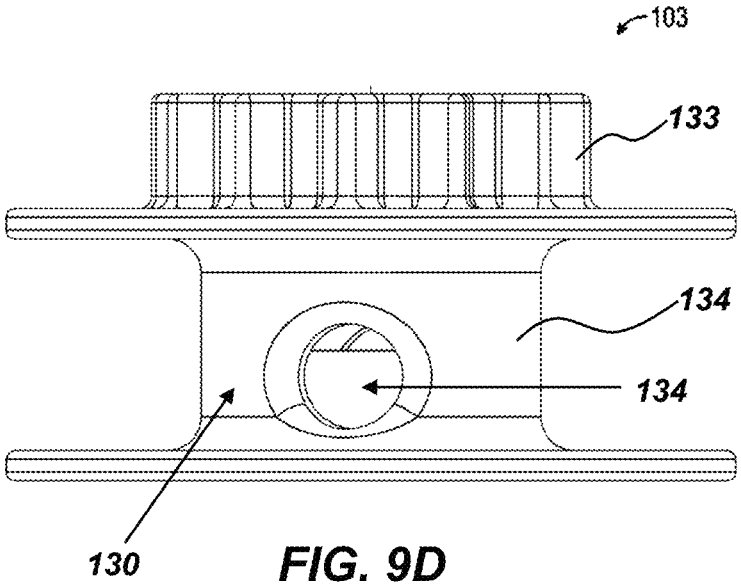
Figure 9E:
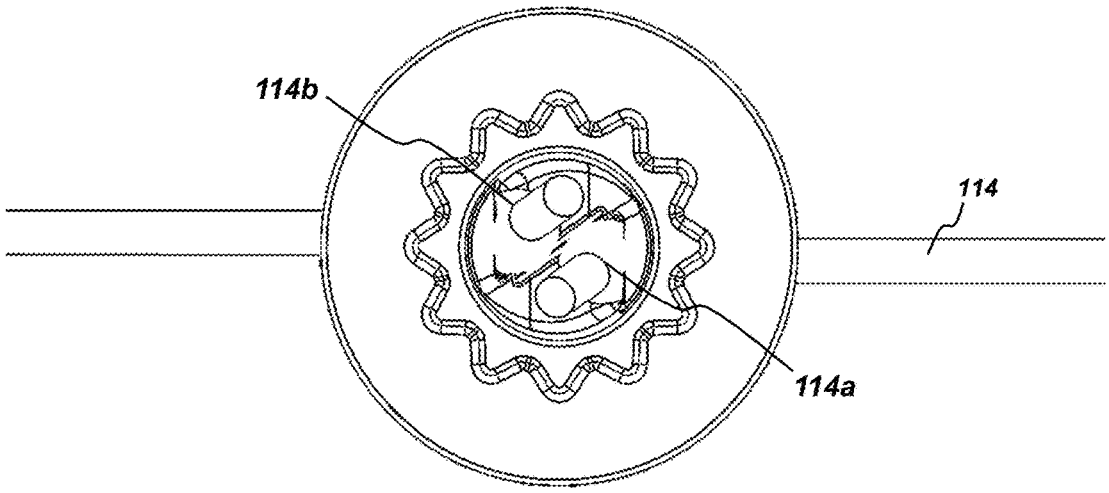
FIG. 9E is a top, plan view of the spool of FIGS. 9A-9D showing a tensioning element on the spool
Figure 9F:
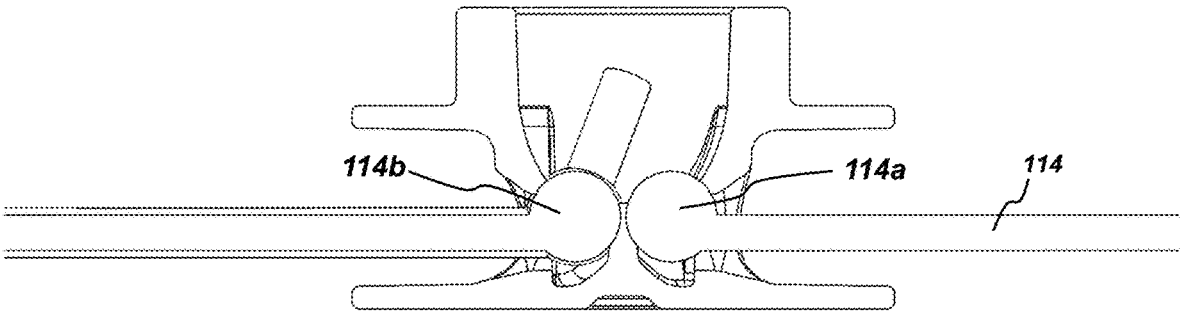
FIG. 9F is a side, cross-sectional view of FIG. 9E.
Figure 10A:
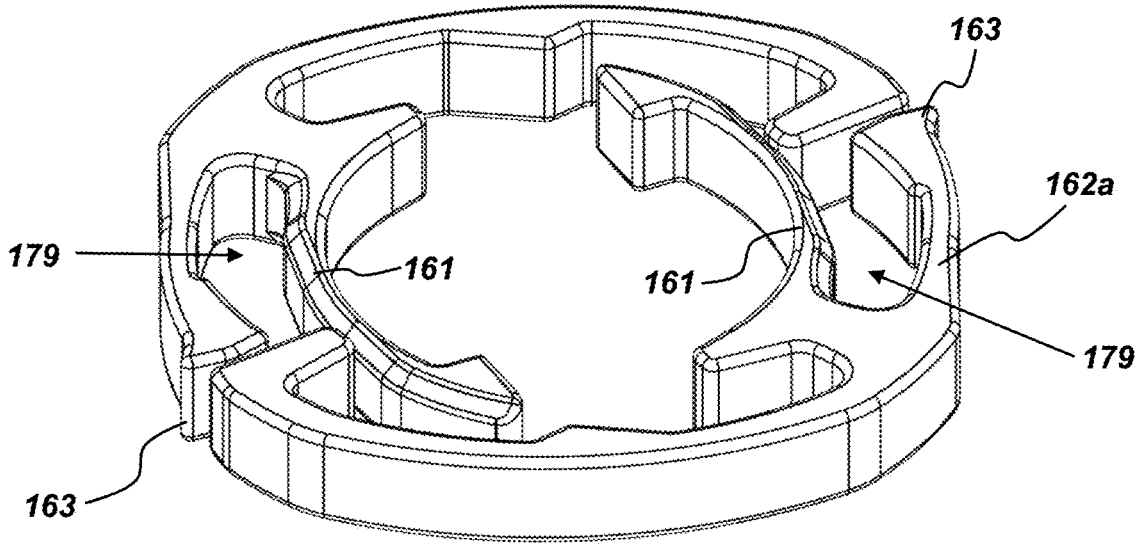
FIGS. 10A-10D are a series of illustrations showing first top perspective and top plan top plan view of a pawl assembly and a first top perspective and top plan view of a single pawl element of the pawl assembly.
Figure 10B:
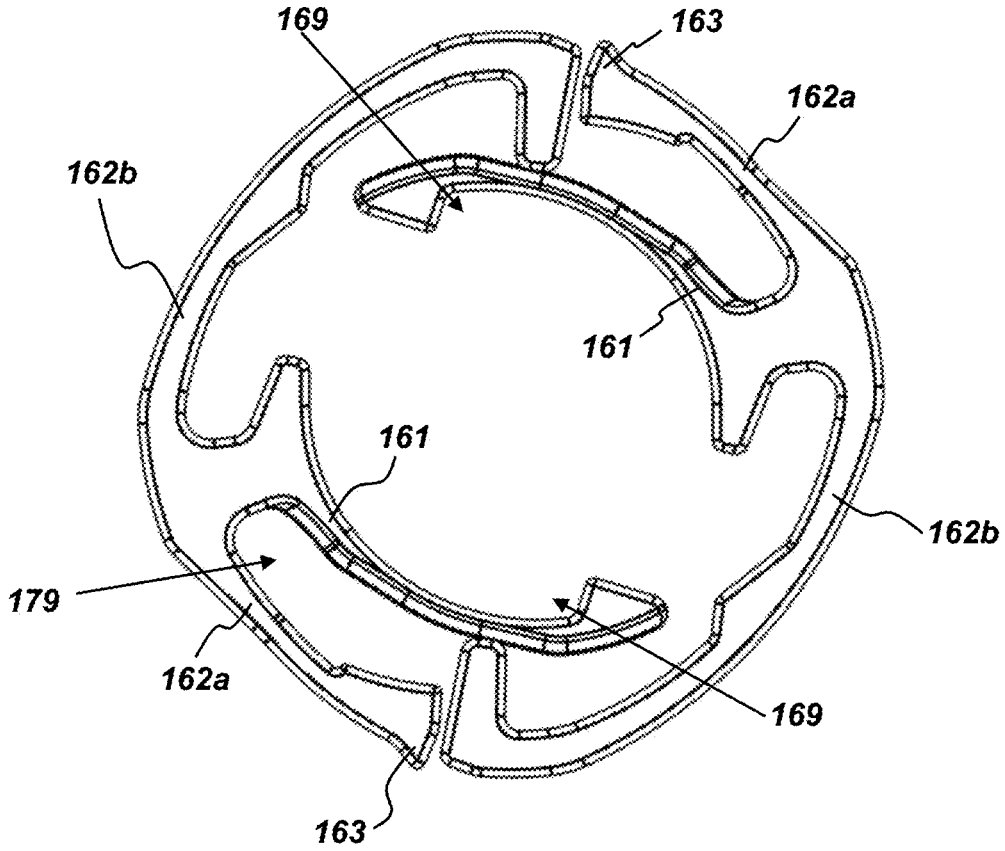
Figure 10C:
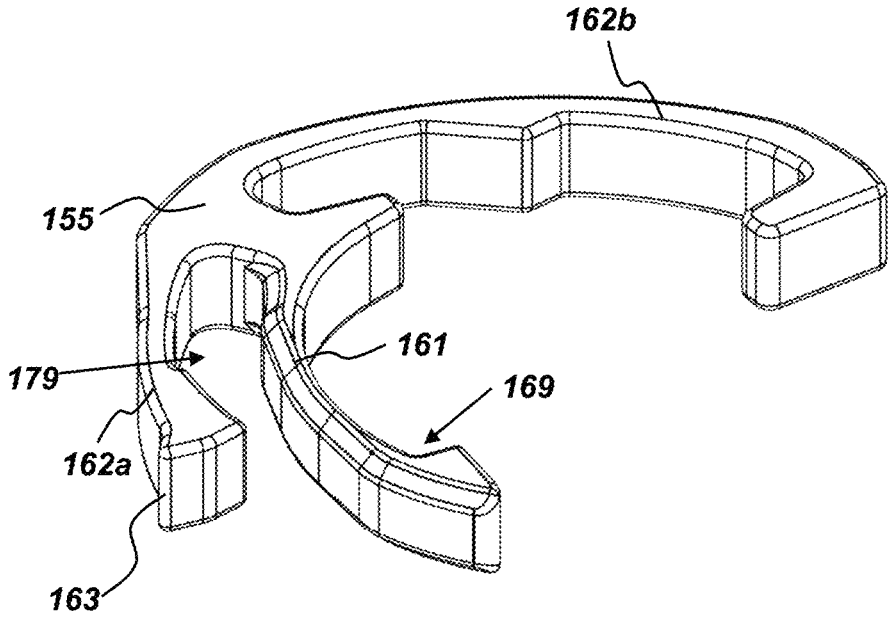
Figure 10D:
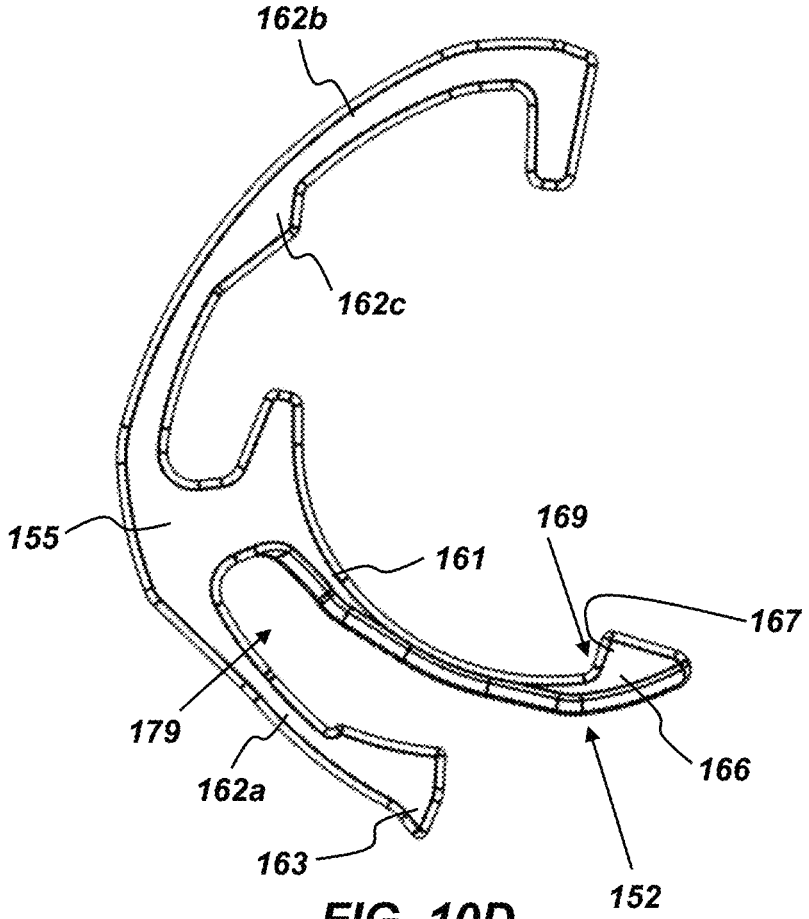

Referring to FIGS. 9E-F, a tensioning element (such as a lace, string, elastic, etc.) 114 can be tied with knots 114*a*, 114*b* in the center of the spool, such that rotation of the spool in a locking direction wraps the tensioning element 114 around the spool.

Referring to FIGS. 10A-10D, the pawl assembly 104 includes a first pawl 150*a* and a second pawl 150*b*. In some embodiments, the pawls 150*a* and 150*b* are identical and reversible. In other embodiments, the pawls 150*a*, 150*b* have directionality and are not reversible.

Each of the pawls includes a body 155 with (i) a first inner arm 161 that includes pawl member 152 for engaging the extension 133 of the spool 103, (ii) a second outer arm 162*a* for engaging the housing 102, and (iii) a third outer arm 162*b*. In some embodiments, the pawl member 152 defines distal portion 166 positioned away from the body 155 in which the distal portion 166 forms an inwardly extending projection 167 defining a pawl recess 169. A slot may be formed between the first inner arm 161 and the second outer arm 162*a* to allow the two arms to move independently (i.e., one can be flexed inwardly while the other can be flexed outwardly). In some configurations, only a first, inner arm 161 is provided. Or, a first and second arm can be provided.

In operation, the pawl assembly 104 is operatively engaged with the extension 133 (FIG. 8A) of the spool 103 to control rotation of the spool 103, essentially "catching" the spool 103. For example, in a locked configuration, the pawl recess 169 of the pawl member 152 engages a respective ridge 141 of the extension 133 such that the spool 103 is caught and cannot rotated.

Each pawl also includes a second outer arm 162*a* to incrementally engage the plurality of teeth 123 (FIGS. 8A and 8C) of the housing 102 as the dial 105 is rotated in the first rotational direction (clock-wise as shown in FIGS. 3A-10) by the user. The second outer arm 162*a* includes a ramped projection 163. The ramped projection allows rotation of the pawl assembly 104 in the clockwise direction within the housing 102, but the ramp prevents counter-rotation in the counter-clockwise direction within the housing 102. The entire pawl assembly can be flipped (i.e., top-to-bottom) to change the direction of the rotation of the pawl assembly 104 within the housing 102.

The pawl assembly 104 further includes a third outer arm 162*b* to engage one of the two opposing ramps 182 (or dial projections 182) on the inner surface 178 of the dial 105. The third outer arm 162*b* can also include one or more ramped projections 162*c* (FIG. 10D) to further interact with the ramps 182, such as to bias the ramps in a locking position. To move from the locking position to the unlocking position, the ramped projections 162*c* have to overcome the ramps 182.

Figure 11A:
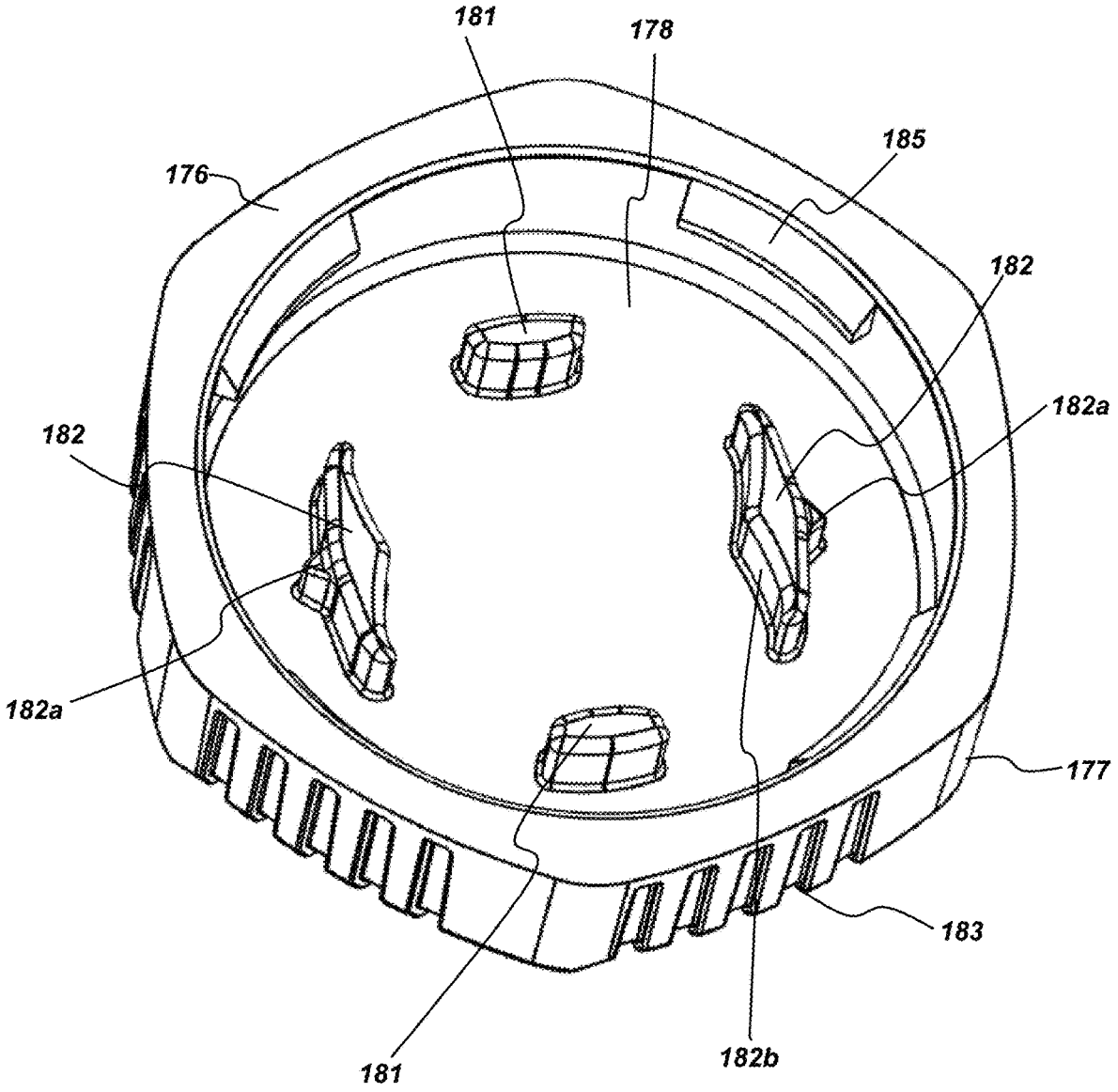
FIG. 11A is a bottom perspective views showing the dial of FIGS. 3A-B.
Figure 11B:
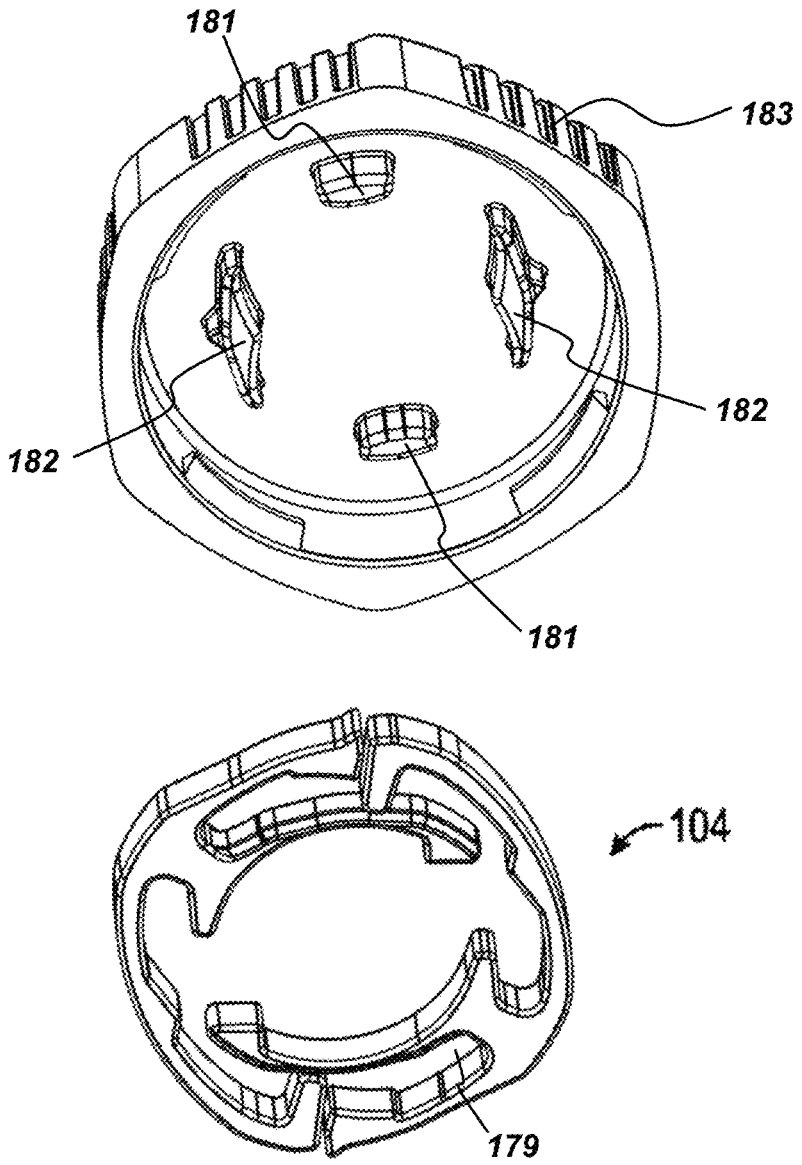
FIG. 11B is a bottom, exploded perspective view showing a dial and a pawl assembly.
Figure 11C:
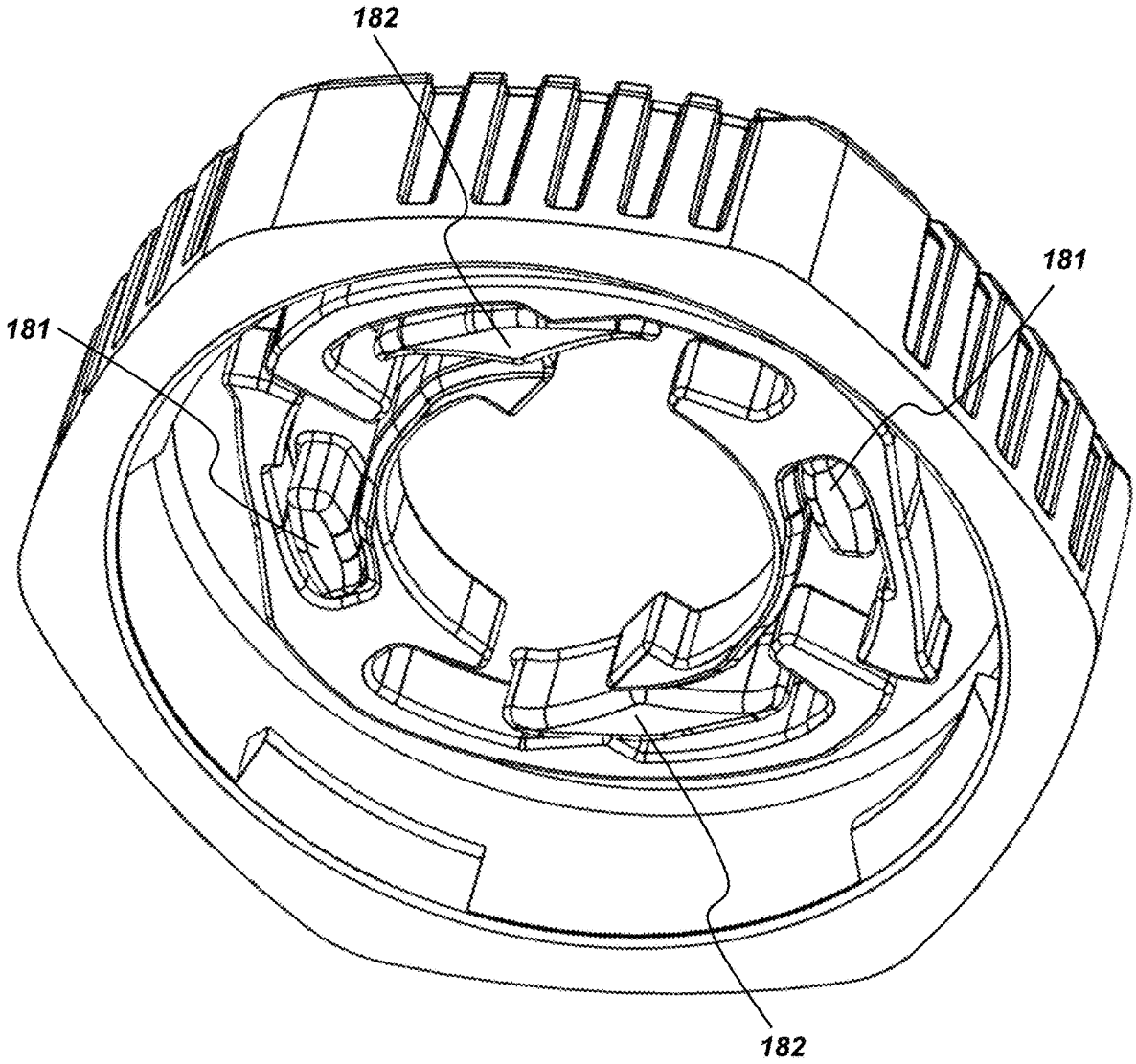
FIG. 11C is a bottom, perspective view showing the dial in connection with the pawl assembly.

The ramps 182 (seen best in FIG. 11) can include an outwardly extending projection 182*a*, and one or more inward ramped portions 182*b*. The inner surface 178 of the dial 105 can also include one or more bosses 181. A slot 179, formed between first inner arm 161 and second outer arm 162*a*, may receive the boss 181 of the inner surface 178 of the dial 105.

The dial 105 provides a means for actuating the rotary closure 100 through manual rotation of the dial 105 indefinitely in the first rotational direction and prevents or limits rotation in the opposite second rotational direction. In some embodiments, the dial 105 includes a body 176 defining an exterior surface 177 and an inner surface 178. In some embodiments, the exterior surface 177 forms a gripping surface 183 configured for gripping by the hand of the user when rotating the dial 105. As specifically shown in FIG. 11A, the dial 105 includes one or more engagement elements 185 for engagement with the circumferential flange 128 of the housing 102 to encapsulate the pawl assembly 104 and form the subassembly 101 of FIGS. 6A and 6B.

Figure 12A:
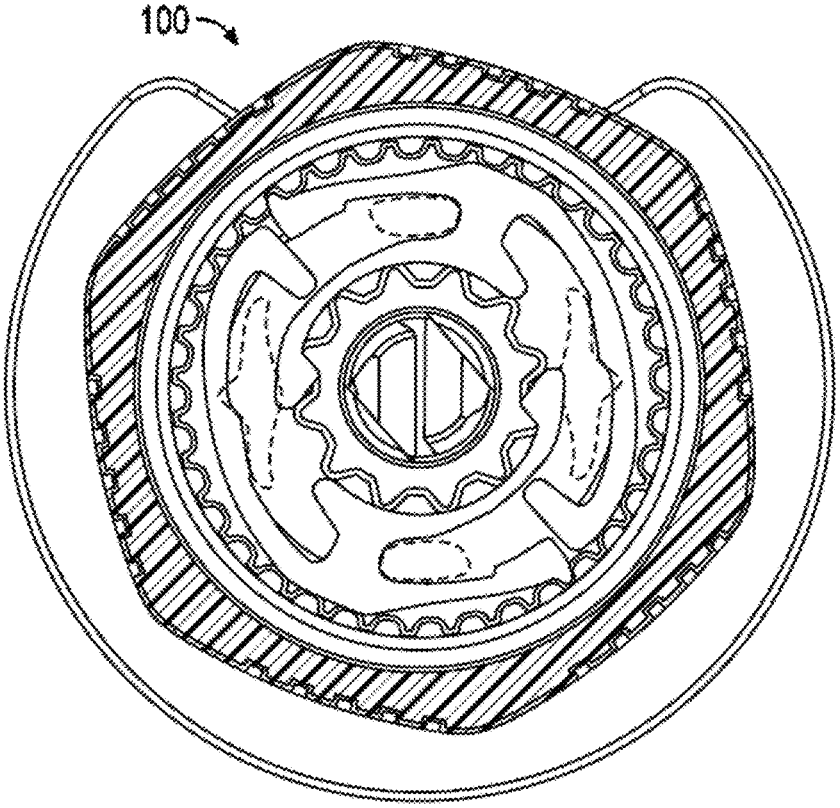
FIG. 12A is a top plan, cross-sectional view of an embodiment of a rotary closure in a locked position.
Figure 12B:
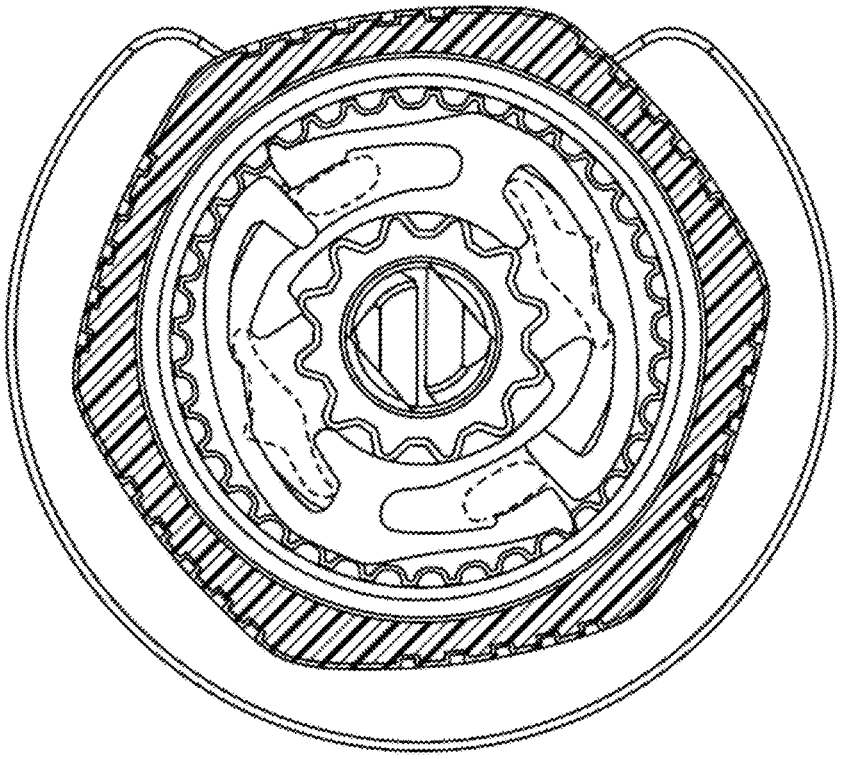
FIG. 12B is a top plan, cross-sectional view of the embodiment of a rotary closure of FIG. 12A in an unlocked position.
Figure 13:
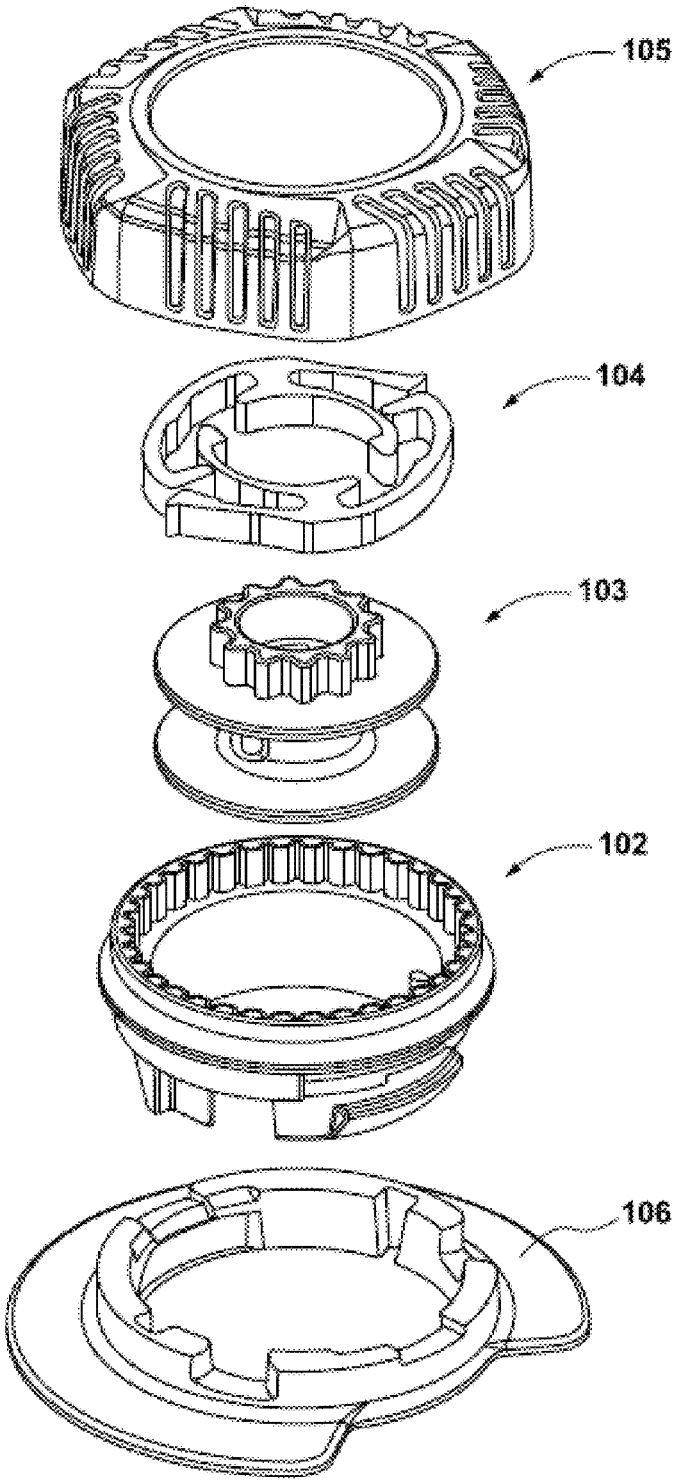
FIG. 13 is a perspective, exploded view of a second embodiment of a rotary closure system, with the pawl assembly flipped relative to FIGS. 3A-B, that allows counter-clockwise rotation.

In some embodiments, the inner surface 178 of the dial 105 forms the opposing ramps 182, which is a protrusion from the inner surface 178. As illustrated in FIG. 12A, in the locked position, the second outer arm 162*a* is engaging the housing 102, with the ramped projection 163 engaging one of the spaces between the plurality of teeth 123 (FIGS. 8A and 8C) of the housing 102. The plurality of teeth are positioned along the periphery of the housing 102. The ramped projection allows rotation of the pawl assembly 104 in the clockwise direction within the housing 102, but the ramp prevents counter-rotation in the counter-clockwise direction within the housing 102. FIG. 12B illustrates the unlocked position.

Figure 14A:
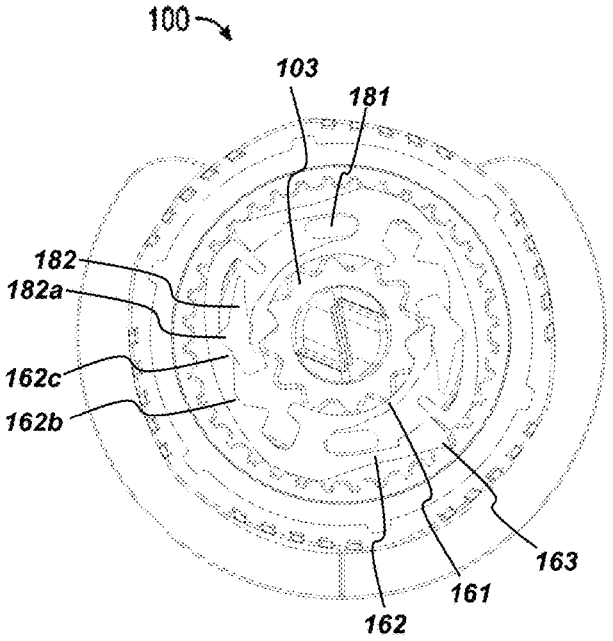
FIG. 14A is a top plan, cross-sectional view of another embodiment of a rotary closure in a locked position.
Figure 14B:
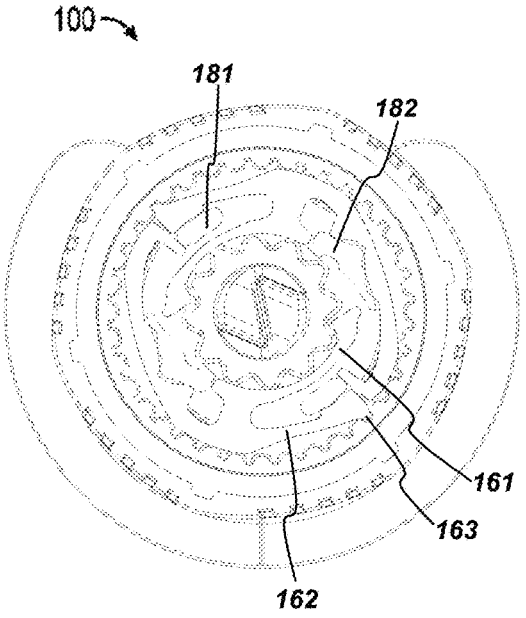
FIG. 14B is a top plan, cross-sectional view of the embodiment of a rotary closure of FIG. 14A in an unlocked position.

FIGS. 14A-14B show another embodiment of a rotary closure 100, which similarly includes a dial 105, a pawl assembly 104, a housing 102, and a base member 106. As before, the dial 105 includes projections/bosses on the underside or inner surface of the dial 105 to engage the pawl assembly 104, housing, and/or spool. In this configuration, the projections/bosses include two oval bosses 181, and two ramps 182. Ramps 182 further include radially outwardly extending projections 182*a*, which interact with the radially inwardly extending projections 162*c* on the third outer arm 162*b* of the pawl assembly to bias the rotary closure system 100 into the locking position. To move from the locking position (FIG. 14A) to the unlocking position (FIG. 14B), the ramped projections 162*c* have to overcome the projections 182*a* of the ramps 182.

When assembled, the rotary closure system 100 has a locked position for engaging the spool 103, and an unlocked position for disengaging from the spool 103. In this embodiment, the locked position has each of the two members of the pawl assembly with (i) an inner arm 161 (FIG. 14A) that engages with the teeth of the spool 103 so rotation of the dial 105 rotates the spool 103, and (ii) an outer arm 162 with a ramped projection 163 that engages the teeth of the housing so the spool 103 can be turned only one way when the pawl assembly is in the locked position. A second outer arm may engage the dial 105. In the unlocked position (FIG. 14B) in this embodiment, the inner arm 161 is released from the spool 103 and able to flex outwardly without being blocked by the ramp 182. That is, the unlocked position has each of the two members of the pawl assembly with (i) an inner arm 161 (FIG. 14B) that released from the teeth of the spool 103 so rotation of the dial 105 is de-coupled from rotation of the spool 103, and (ii) an outer arm 162 with a ramped projection 163 that remains engaged with the teeth of the housing.

Figure 15A:
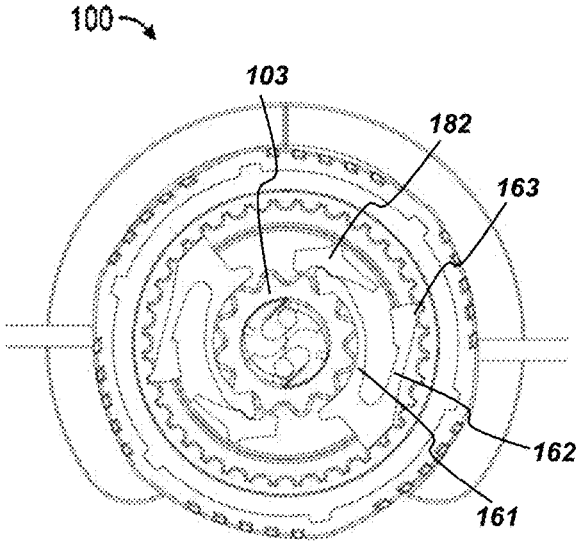
FIG. 15A is a top plan, cross-sectional view of another embodiment of a rotary closure in a locked position.
Figure 15B:
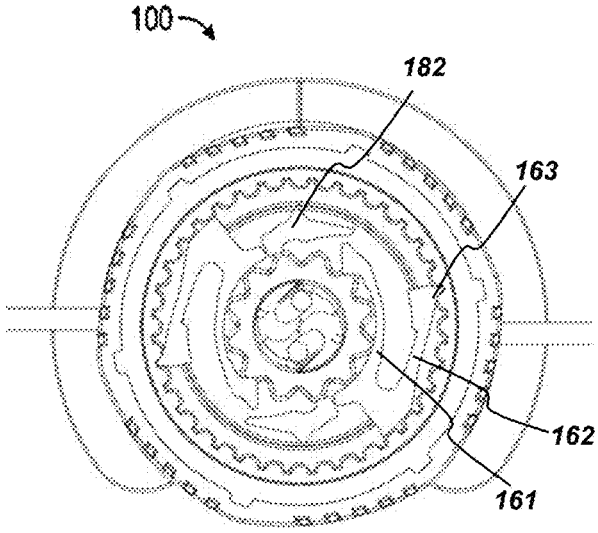
FIG. 15B is a top plan, cross-sectional view of the embodiment of a rotary closure of FIG. 15A in an unlocked position.

FIGS. 15A-15B show another embodiment of a rotary closure 100, which similarly includes a dial 105, a pawl assembly 104, a housing 102, and a base member 106. As before, the dial 105 includes projections/bosses on the underside or inner surface of the dial 105 to engage the pawl assembly 104, housing, and/or spool. In this configuration, the projections/bosses include two ramps 182, and the pawl assembly includes a first pawl and a second pawl, each with an inner arm 161 and an outer arm 162.

When assembled, the rotary closure system 100 has a locked position for engaging the spool 103, and an unlocked position for disengaging from the spool 103. In this embodiment, the locked position has each of the two members of the pawl assembly with (i) an inner arm 161 (FIG. 15A) that engages with the teeth of the spool 103 so rotation of the dial 105 rotates the spool 103, and (ii) an outer arm 162 with a ramped projection 163 that engages the teeth of the housing so the spool 103 can be turned only one way when the pawl assembly is in the locked position. In the unlocked position (FIG. 15B) in this embodiment, the inner arm 161 is released from the spool 103 and able to flex outwardly without being blocked by the ramp 182. That is, the unlocked position has each of the two members of the pawl assembly with (i) an inner arm 161 (FIG. 15B) that released from the teeth of the spool 103 so rotation of the dial 105 is de-coupled from rotation of the spool 103, and (ii) an outer arm 162 with a ramped projection 163 that remains engaged with the teeth of the housing.

Figure 16A:
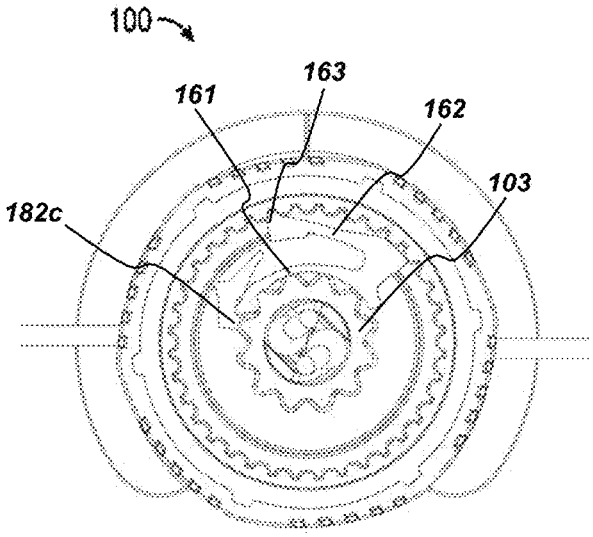
FIG. 16A is a top plan, cross-sectional view of another embodiment of a rotary closure in a locked position.
Figure 16B:
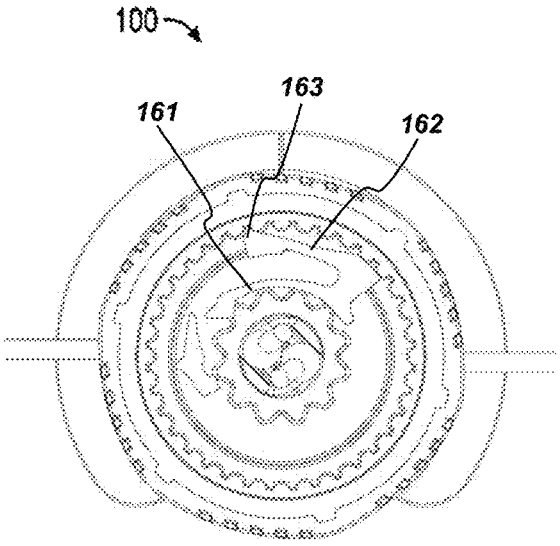
FIG. 16B is a top plan, cross-sectional view of the embodiment of a rotary closure of FIG. 16A in an unlocked position.

FIGS. 16A-16B show another embodiment of a rotary closure 100, which similarly includes a dial 105, a pawl assembly 104, a housing 102, and a base member 106. In this configuration, the dial 105 includes a projection on the underside or inner surface of the dial 105 to engage the pawl assembly 104, housing, and/or spool. In this configuration, the projection/boss is a ramp 182, and the pawl assembly includes a first pawl with an inner arm 161 and an outer arm 162. Ramp 182 includes a hook 182*c* to rotationally couple the dial to the pawl assembly. The hook 182*c* engages the inner arm 161 of the pawl assembly such that rotation of the dial in the locking direction rotates the pawl assembly and the spool 103 in the locking direction.

When assembled, the rotary closure system 100 has a locked position for engaging the spool 103, and an unlocked position for disengaging from the spool 103. In this embodiment, the locked position has the single pawl of the pawl assembly with (i) an inner arm 161 (FIG. 16A) that engages with the teeth of the spool 103 so rotation of the dial 105 rotates the spool 103, and (ii) an outer arm 162 with a ramped projection 163 that engages the teeth of the housing so the spool 103 can be turned only one way when the pawl assembly is in the locked position. In the unlocked position (FIG. 16B) in this embodiment, the inner arm 161 is released from the spool 103 and able to flex outwardly without being blocked from outwardly flexion by the ramp 182.

In one method of assembly of the rotary closure 100, the housing 102 allows manufacturers to assemble the dial 105, the pawl assembly 104 and the housing 102 together in a snap-fit engagement as the subassembly 101. The subassembly 101 enables a manufacturer to ensure that the dial 105, pawl assembly 104 and the housing 102 are working properly prior to full assembly of the rotary closure 100. The spool 103 and associated tensioning element (not shown) can thereafter be coupled with the subassembly 101 either by the manufacturer or by a consumer. The formation of the subassembly 101 also enables the consumer to remove and/or replace the spool 103 in case of jamming or to replace the tensioning element without complete disassembly of the housing 102 from the dial 105 and the pawl assembly 104, thus reducing a likelihood of destruction of the rotary closure 100.

The subassembly 101 can be assembled by coupling the pawl assembly 104 with the dial 105. Next, the housing 102 is coupled with the dial 105 by snapping the circumferential flange 128 of the housing 102 to the inner surface 178 of the dial 105 by the one or more engagement elements 185 of the dial 105 as discussed above and as illustrated in FIG. 6A. Following formation of the subassembly 101, the spool 103 can be coupled with the subassembly 101 by inserting the spool into the housing 102. The subassembly 101 and spool 103 can then be coupled with the base member 106 by snapping the first retention and second retention members 127A and 127B of the housing 102 into the opposing first and second slots 109, 110, respectively, of the base member 106. In some embodiments, the base member 106 can be stitched into a shoe (not shown) or can be present on another device that requires tightening of a tensioning element such as a container. The base member 106 can include any desired method to connect the closure system to a garment or a shoe, such as rivet holes, velcro, an integrated fabric material, etc.

In prior art configurations, it was required to provide a right-handed rotary closure as well as a separate left-handed rotary closure, with the left-handed rotary closure including the same components but completely mirrored across the vertical axis, including a mirrored flange, a mirrored dial, a mirrored pawl assembly, a mirror spool, and a mirrored housing. However, according to the present disclosure, a single rotary closure can be manufactured that allows for right-or left-handed closure by simply flipping (i.e., rotating from top to bottom) the reversible pawl assembly. This allows for easier manufacturing, as well as numerous options for installation by a manufacturer or user without having to buy a specifically-handed rotary closure. In some configurations, the pawl assembly may have directionality and not be reversible.

EMBODIMENTS

The following embodiments are provided as examples only of specific configurations, materials, arrangements, etc. contemplated by the authors of this disclosure:

Embodiment 1: A rotary closure system comprising: a flange coupled to a housing, a spool receivable within the housing; a first pawl element and a second pawl element engaging an inner side of a dial and the housing; wherein the first pawl element and the second pawl element form a pawl assembly and wherein the pawl assembly has a first position to allow the rotary closure to be a right-handed rotary closure and a second position to allow the rotary closure to be a left-handed rotary closure.

Embodiment 2: The rotary closure system of embodiment 1, wherein the first pawl element comprises a first inward arm that includes a pawl member for engaging an extension of the spool.

Embodiment 3: The rotary closure system of embodiment 1, wherein the first pawl element comprises a second outer arm for engaging the housing.

Embodiment 4: The rotary closure system of embodiment 1, wherein the first pawl element comprises a third outer arm for engaging the dial.

Embodiment 5: The rotary closure system of embodiment 1, wherein the inner side of the dial further comprises two opposing ramps to lock the pawl assembly in place.

Embodiment 6: A rotary closure system comprising: a housing, a spool receivable within the housing; a first pawl and a second pawl engaging an inner side of a dial and the housing; and wherein the first pawl and the second pawl form a pawl assembly and wherein the pawl assembly has a first position to allow the rotary closure system to be a right-handed rotary closure and a second position to allow the rotary closure system to be a left-handed rotary closure.

Embodiment 7: The rotary closure system of embodiment 6, wherein the housing further comprises a flange for attaching the rotary closure system to a shoe.

Embodiment 8: A rotary closure system comprising: a dial with a projection on an underside of the dial to engage a pawl assembly; the pawl assembly in connection with teeth of a housing; the housing receiving a spool therein, and the housing having teeth around a peripheral edge, the pawl assembly engageable with the teeth; and a flange coupled to a housing; wherein the rotary closure system has a first, locked position and a second, unlocked position; wherein, in the first, locked position, an inner arm of the pawl assembly engages the spool and a tooth of the housing; and wherein, in the second, unlocked position, the inner arm of the pawl assembly disengages the spool.

Embodiment 9: The rotary closure system of embodiment 8, wherein the pawl assembly comprises a first pawl and a second pawl.

Embodiment 10: The rotary closure system of embodiment 8 or 9, wherein the first pawl and the second pawl are reversible.

Embodiment 11: The rotary closure system of any one of embodiments 8-10, wherein the first pawl and the second pawl each comprise a body with: a first inner arm for engaging the spool, a second outer arm for engaging the teeth of the housing and incrementally tightening the spool as the dial is turned in a locking direction in the first, locked position; and a third outer arm for engaging the dial.

Embodiment 12: The rotary closure system of any one of embodiments 8-11, wherein the second outer arm includes a ramped projection for engaging a tooth of the housing.

Embodiment 13: The rotary closure system of any one of embodiments 8-12, wherein the projection on the underside of the dial comprises a first projection to engage a first pawl of the pawl assembly and a second projection to engage a second pawl of the pawl assembly.

Embodiment 14: The rotary closure system of any one of embodiments 8-13, wherein the first projection of the dial engages the third outer arm of the first pawl, and wherein the second projection of the dial engages the third outer arm of the second pawl.

Embodiment 15: The rotary closure system of any one of embodiments 8-14, wherein the dial further comprises a first protuberance on the underside of the dial and wherein, in the second, unlocked position, the first protuberance is positioned radially inward from the ramped projection of the second outer arm of the first pawl, preventing the second outer arm of the first pawl from flexing radially inwardly.

Embodiment 16: The rotary closure system of any one of embodiments 8-15, wherein the first and second projections of the dial are ramped.

Embodiment 17: The rotary closure system of any one of embodiments 8-16, wherein the third outer arm for engaging the dial includes a radially inwardly extending projection to interface with the dial projection and provide resistance between the first, locked position and the second, unlocked position.

Embodiment 18: The rotary closure system of any one of embodiments 8-17, wherein the flange is integral to the housing.

The various embodiments described above, including elements of the various embodiments described above, can be combined to provide further embodiments. Various portions and components of apparatus within the scope of this disclosure, including for example, structural components, can be formed by one or more various suitable manufacturing processes known to those in the art. Similarly, various portions and components of apparatuses within the scope of this disclosure can be made from suitable materials known to those in the art.

Exemplary embodiments of the present disclosure will be described in detail with reference to the accompanying drawings. Advantages and features of the present disclosure and methods accomplishing them will become apparent from the following description of exemplary embodiments with reference to the accompanying drawings.

It will be appreciated that various aspects discussed in reference to one drawing may be present and/or used in conjunction with the embodiment shown in another drawing, and each element shown in multiple drawings may be discussed only once.

Reference in the specification to "one configuration," "one embodiment," "a configuration," or "an embodiment" means that a particular feature, structure, or characteristic described in connection with the configuration is included in at least one configuration, but is not a requirement that such feature, structure, or characteristic be present in any particular configuration unless expressly set forth in the embodiments as being present.

Furthermore, the described features, structures, or characteristics of configurations of the disclosed subject matter may be combined in any suitable manner in one or more configurations. Configurations of the disclosed subject matter may be practiced without one or more of the specific details, or with other methods, components, materials, and so forth. In other instances, well-known structures, materials, or operations are not shown or described in detail to avoid obscuring aspects of the invention.

It should also be noted that, as used in this specification and the appended embodiments, singular forms such as "a," "an," and "the" may include the plural unless the context clearly dictates otherwise. Thus, for example, reference to "a base" may include one or more of such bases, and reference to "the pawl" may include reference to one or more of such pawls.

As used herein, a plurality of items, structural elements, compositional elements, and/or materials may be presented in a common list for convenience. However, these lists should be construed as though each member of the list is individually identified as a separate and unique member. Unless otherwise indicated, all numbers expressing quantities used in the specification and embodiments are to be understood as being modified in all instances by the term "about." Accordingly, unless indicated to the contrary, the numerical parameters set forth in the specification and attached embodiments are approximations that may vary depending upon the desired properties sought to be obtained by the embodiments of the present disclosure. At the very least, and not as an attempt to limit the application of the doctrine of equivalents to the scope of the embodiments, each numerical parameter should at least be construed in light of the number of reported significant digits and by applying ordinary rounding techniques. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. In one embodiment, the terms "about" and "approximately" refer to numerical parameters within 10% of the indicated range.

All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

The above description has set out various features, functions, methods, and other aspects of the disclosure. Time and further development may change the manner in which the various aspects are implemented. The scope of protection defined by the claims is not intended to be limited to the specific sizes, shapes, features, or other aspects of the disclosed embodiments. The claimed inventions may be implemented or embodied in other forms while still being within the scopes of the concepts disclosed hereby. For example, while the rotary closure herein has been described with respect to use with a shoe, the rotary closure system can also be implemented in other settings without departing from the scope of the claims and/or disclosure. Also included are equivalents of the elements of the claims that can be made without departing from the scopes of concepts properly protected by the claims that follow.

What is claimed:

1. A rotary closure system comprising:

a dial with a plurality of projections on an underside of the dial to engage a pawl assembly and rotationally lock the pawl assembly to the dial such that rotation of the dial in a locking direction rotates the pawl assembly in the locking direction;

the pawl assembly in connection with a housing, and the pawl assembly comprising a first, inner arm for selectively coupling to a spool and a second, outer arm for engaging teeth of the housing, and a slot formed between the first, inner arm and the second, outer arm, the slot allowing the first, inner arm and the second, outer arm to move independently;

the housing receiving the spool, and the housing having the teeth around a peripheral edge of the housing, the second, outer arm of the pawl assembly engageable with the teeth; and a base member coupled to the housing;

wherein the rotary closure system has a first, locked position and a second, unlocked position;

wherein, in the first, locked position, the pawl assembly engages the spool and the teeth of the housing;

wherein, in the second, unlocked position, the pawl assembly disengages the spool;

wherein the pawl assembly comprises a first pawl and a second pawl, and wherein the first pawl and the second pawl are identical and reversible, and the first pawl and the second pawl each comprise a body with:

the first, inner arm for engaging the spool, the second, outer arm with a ramped projection for engaging the teeth of the housing and incrementally tightening the spool as the dial is turned in a locking direction in the first, locked position; and a third outer arm for engaging the dial;

wherein the plurality of projections on the underside of the dial comprises a first projection to engage the first pawl of the pawl assembly and a second projection to engage the second pawl of the pawl assembly, and wherein the first projection of the dial engages the third outer arm of the first pawl, and wherein the second projection of the dial engages the third outer arm of the second pawl.

2. The rotary closure system of claim 1, wherein the pawl assembly comprises a slot formed between the first, inner arm and the second, outer arm, the slot for receiving one of the plurality of projections of the dial.

3. The rotary closure system of claim 1, wherein a first projection of the plurality of projections comprises a ramp, the ramp engaging the first, inner arm of the pawl assembly to rotationally lock the pawl assembly to the dial such that rotation of the dial in the locking direction rotates the pawl assembly in the locking direction.

4. The rotary closure system of claim 1, wherein the base member is integral to the housing.

5. The rotary closure system of claim 1, wherein the pawl assembly comprises one or more pawls.

6. The rotary closure system of claim 1, wherein the dial further comprises a first protuberance on the underside of the dial and wherein, in the second, unlocked position, the first protuberance is positioned radially inward from the ramped projection of the second outer arm of the first pawl, preventing the second outer arm of the first pawl from flexing radially inwardly.

7. The rotary closure system of claim 6, wherein the first and second projections of the dial are ramped.

8. The rotary closure system of claim 7, wherein the third outer arm for engaging the dial includes a radially inwardly extending projection to interface with the ramped dial projection and provide resistance between the first, locked position and the second, unlocked position.

* * * * *